US012234697B2

(12) United States Patent
Siwak et al.

(10) Patent No.: US 12,234,697 B2
(45) Date of Patent: Feb. 25, 2025

(54) LOCK MECHANISM FOR BIT RUN TOOL AND REPLACEABLE BLADES

(71) Applicant: Baker Hughes Oilfield Operations LLC, Houston, TX (US)

(72) Inventors: Jan Siwak, Warsaw (PL); Philip Potter, Houston, TX (US); Callum Frieslick, Aberdeen (GB)

(73) Assignee: Baker Hughes Oilfield Operations LLC, Houston, TX (US)

( * ) Notice: Subject to any disclaimer, the term of this patent is extended or adjusted under 35 U.S.C. 154(b) by 106 days.

(21) Appl. No.: 17/963,000

(22) Filed: Oct. 10, 2022

(65) Prior Publication Data

US 2023/0116845 A1 Apr. 13, 2023

Related U.S. Application Data

(60) Provisional application No. 63/254,783, filed on Oct. 12, 2021.

(51) Int. Cl.
*E21B 23/02* (2006.01)

(52) U.S. Cl.
CPC ..... *E21B 23/02* (2013.01)

(58) Field of Classification Search
CPC ..... E21B 10/20; E21B 10/26; E21B 10/62; E21B 17/1007; E21B 17/1078; E21B 23/02
See application file for complete search history.

(56) References Cited

U.S. PATENT DOCUMENTS 1,764,373 A * 6/1930 Wells ..... E21B 10/325 175/283
4,190,124 A * 2/1980 Terry ..... E21B 10/56 403/DIG. 8
4,549,613 A * 10/1985 Case ..... E21B 17/02 175/325.2

(Continued)

FOREIGN PATENT DOCUMENTS

GB 2355036 A * 4/2001 ..... E21B 10/10
WO 2016/144301 9/2016

(Continued)

OTHER PUBLICATIONS

Kirk R. Shirley, "The Underreamer—Its Versatility In Offshore Drilling And Construction," May 2, 1976, Offshore Technology Conference, Houston, Texas, 2 pages.

(Continued)

*Primary Examiner* — Jennifer H Gay
(74) *Attorney, Agent, or Firm* — Hogan Lovells US LLP

(57) ABSTRACT

A tool assembly, a method and a system to be used in a downhole environment for downhole operations such as runs and retrieval of features are disclosed. A tool assembly include an outer tool profile, an inner matching profile, and a first interfacing surface. The inner matching profile is to be associated with an interfacing profile of a tool body and is to allow axial sliding for a first lock of the tool assembly to the tool body. A second lock is provided at a first shoulder-surface interface between the first interfacing surface and the tool body. The tool assembly is to be changeably associated with the tool body for use in the downhole operations.

20 Claims, 16 Drawing Sheets

(56) References Cited

U.S. PATENT DOCUMENTS 4,557,339 A * 12/1985 Falknor ..... E21B 17/1078 403/381
5,010,967 A * 4/1991 Desai ..... E21B 29/002 166/55.7
5,447,207 A 9/1995 Jones
6,719,044 B2 4/2004 Ford
6,745,858 B1 * 6/2004 Estes ..... E21B 10/20 299/85.2
6,945,325 B2 9/2005 Ford
7,191,835 B2 3/2007 Howlett
7,654,342 B2 * 2/2010 Lassoie ..... E21B 10/322 175/286
7,665,550 B2 * 2/2010 Rives ..... E21B 10/62 175/286
8,074,724 B2 12/2011 Minassian
9,051,792 B2 * 6/2015 Herberg ..... E21B 10/32
9,611,698 B2 * 4/2017 Maher ..... E21B 10/24
9,689,213 B2 * 6/2017 Khaparde ..... E21B 17/1078
9,828,805 B2 * 11/2017 Gunsaulis ..... E21B 7/30
10,208,545 B2 * 2/2019 Newman ..... E21B 17/1078
10,337,271 B2 * 7/2019 Robertson ..... E21B 29/00
10,753,161 B2 8/2020 Silveira
11,047,192 B2 * 6/2021 Robertson ..... E21B 29/00
11,248,430 B2 * 2/2022 Ruttley ..... E21B 17/1021
11,377,909 B2 7/2022 Odell, II
11,421,478 B2 * 8/2022 Herberg ..... E21B 1/32
11,421,482 B2 * 8/2022 Graham ..... E21B 10/633
11,795,762 B2 * 10/2023 Irsa ..... E21B 10/43
2008/0115973 A1 * 5/2008 Rives ..... E21B 10/62 175/57
2008/0251295 A1 * 10/2008 Lassoie ..... E21B 10/322 175/57
2012/0018173 A1 * 1/2012 Herberg ..... E21B 47/12 166/85.1
2014/0305708 A1 * 10/2014 Gunsaulis ..... E21B 7/046 175/406
2014/0338984 A1 * 11/2014 Maher ..... E21B 10/22 175/336
2016/0237762 A1 * 8/2016 Khaparde ..... E21B 17/1078
2016/0265287 A1 * 9/2016 Newman ..... E21B 17/1078
2016/0265294 A1 * 9/2016 Robertson ..... E21B 29/00
2017/0183914 A1 * 6/2017 Herberg ..... E21B 1/32
2019/0323310 A1 * 10/2019 Robertson ..... E21B 23/02
2021/0025243 A1 * 1/2021 Graham ..... E21B 10/633
2021/0198951 A1 * 7/2021 Irsa ..... E21B 10/43
2021/0324696 A1 * 10/2021 Ruttley ..... E21B 17/1021
2023/0116845 A1 * 4/2023 Siwak ..... E21B 23/02 166/381

FOREIGN PATENT DOCUMENTS

WO 2016144301 A1 9/2016
WO WO-2016135511 A1 * 9/2016
WO 2020/071920 4/2020
WO 2020071920 A1 4/2020

OTHER PUBLICATIONS

International Search Report and Written Opinion mailed Jan. 31, 2023 in corresponding PCT Application No. PCT/US2022/077906.
International Search Report and Written Opinion issued in PCT Application No. PCT/US2022/077906, mailed Jan. 31, 2023.

* cited by examiner

LOCK MECHANISM FOR BIT RUN TOOL AND REPLACEABLE BLADES

CROSS-REFERENCES TO RELATED APPLICATIONS

This application is related to and claims the benefit of priority from U.S. Provisional Application 63/254,783, titled LOCK MECHANISM FOR BIT RUN TOOL AND REPLACEABLE BLADES, filed Oct. 12, 2021, the entire disclosure of which is incorporated by reference herein for all intents and purposes.

BACKGROUND

1. Field of the Invention

The present disclosure relates to a system and method for performing downhole operations. More specifically, the present disclosure relates to tool assemblies to be interchangeably associated with a tool body for runs into a downhole environment and for downhole retrieval of features from the downhole environment.

2. Description of Related Art

As part of drilling of a subsurface formation, during and after such drilling, various types of run or retrieval operations may be performed to run features into a downhole environment or to retrieve features from a downhole environment. A failure hazard and impact associated with such retrieval operations, and particularly of a unibody or integrated design, include loss of blades or components falling downhole. Commercial issues may also exist as related to high costs and long lead times for replacing or using such run or retrieval tools. Further, a large carbon footprint impact relating to manufacturing is tied to such run or retrieval tools. For example, a tool body that needs to be replaced after every run or retrieval operation increases transport, storage, and machining costs, but also has less reliability. The transportation costs may be tied to requirements to transport the entire tool for repair.

SUMMARY

In one embodiment, a system for downhole operations is disclosed. The system includes a tool body having an interfacing profile. The system also includes a tool assembly having an outer tool profile and an inner matching profile, the inner matching profile to be associated with the interfacing profile. The tool assembly is to be changeably associated with the tool body for use in the downhole operations.

In at least one embodiment, a tool assembly is disclosed for use in downhole environments. The tool assembly has an outer tool profile and an inner matching profile, the inner matching profile to be associated with the interfacing profile of the tool body. The tool assembly is to be changeably associated with the tool body for use in downhole operations.

In at least one embodiment, a method for downhole operations is disclosed. The method includes providing a tool body having an interfacing profile. The method also includes enabling a tool assembly to include an outer tool profile and an inner matching profile, the inner matching profile to be associated with the interfacing profile. The tool assembly is to be changeably associated with the tool body for use in the downhole operations.

BRIEF DESCRIPTION OF DRAWINGS

Various embodiments in accordance with the present disclosure will be described with reference to the drawings, in which.

DETAILED DESCRIPTION

Figure 1:
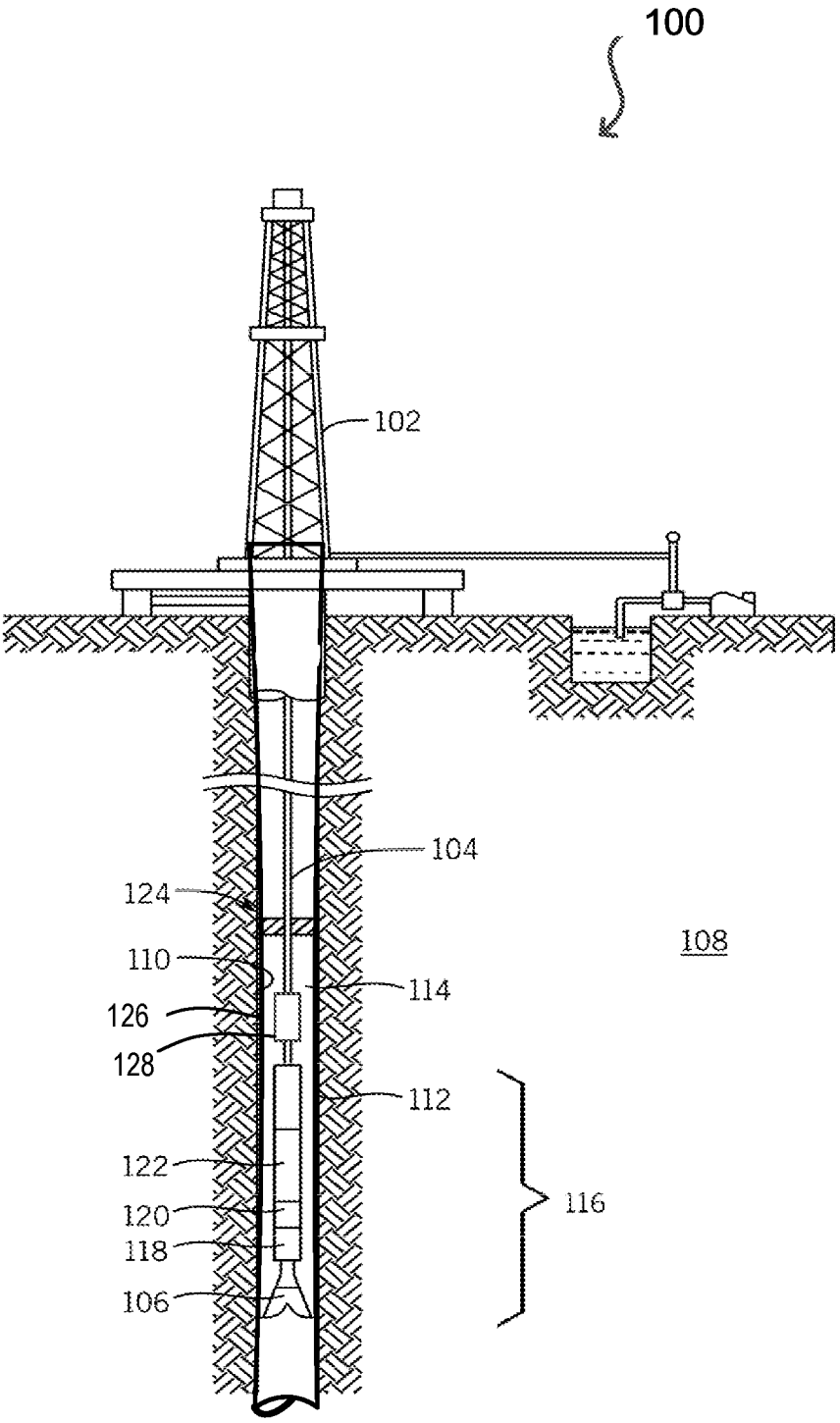
FIG. 1 is a schematic view of an embodiment of a system for performing downhole run or retrieval operations, in accordance with embodiments of the present disclosure.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Various other functions can be implemented within the various embodiments as well as discussed and suggested elsewhere herein. In at least one embodiment, the present disclosure is to a system and a method for performing downhole run and/or retrieval operations, and more specifically, to tool assemblies to be interchangeably associated with a tool body for downhole run that and/or retrieval operations on features associated with a downhole environment.

In at least one embodiment, a tool body with a tool assembly represents a system that may be used for both run and retrieval operations to be performed in a single trip to run features into the downhole environment and to retrieve wear bushings (WB) and nominal seat protectors (NSP) from a downhole environment. Such run and retrieval operations may be combined with a bottom hole assembly (BHA) for tripping in and out of a well bore during drilling activities. However, only run operations may be performed using the tool assembly and tool body where the WB/NSP features are left as installed in the downhole environment. Similarly, only retrieval operations may be performed by the system. The system is, therefore, able to address various deficiencies previously described by use of a replaceable blade design that forms a tool assembly to be associated with a tool body in a changeably manner.

In at least one embodiment, such replaceable blade design may be provided in various sizes. For example, an outer profile of a tool assembly may be sized to meet an inner diameter requirements of specific downhole environments in which run and/or retrieval operations are performed, such as, a borehole or a casing hanger of different inner diameters. Even with the different sized outer profile, such a tool assembly may have a standard matching profile to mate with an outer profile of a tool body. As such, the tool body represents a universal main body in a way that prevents components, such as a tool assembly, from fall of the tool body during operation.

In at least one embodiment, fastening features are provided between the tool assembly and the tool body, where such fastening features do not incorporate components capable of falling downhole. A system of a tool body and tool assembly herein maintains an existing bit run profile for its outer profile of the tool assembly to prevent requirement for changes to be made to a nominal seal protector (NSP) or wear to bushings associated with such a system.

In at least one embodiment, a tool assembly includes blades that are manufactured using additive hard facing methods so that such a tool assembly can be repaired without a need for scrapping the entire system that would have otherwise been the case for a unibody downhole tool having an outer tool profile. In at least one embodiment, hard facing on a tool assembly improves wear resistance, while providing bolt-on or slide on tool components with impact loading protection and stress distribution advantageously address issues of other run and/or retrieval tools. The present system dramatically increases commercial flexibility by offering, among other benefits, a faster turnaround time relating to repair or refurbishing a tool assembly, which in turn translates to time saving opportunities that can be passed on to downstream users and translates to lesser demands on a supply chain associated with such a system.

In at least one embodiment, use of a changeable tool assembly with a tool body also provides an opportunity to use replaceable blades dimensioned to the downhole environment, which increases available use for single components (such as, tool bodies) and provides opportunities for use of a single component across multiple products and designs. For example, a tool body may be a universal tool for running and retrieving features from wellbores that are other than a single entity's wellbore, such as, by providing a tool assembly that incorporates wellbore-specific outer profiles.

In at least one embodiment, a tool assembly herein offers replaceable blade designs fitted to a tool body with features that cannot fall from a system that includes the tool body during operation. Fastening features to associate, including to lock, the tool assembly to the tool body are described herein, where such fastening features are without components that can fall downhole.

In at least one embodiment, a unique geometry, such as raised or inset dovetail features on a tool body and matching inset or raised dovetail features on an inner surface of a tool assembly, provide matching profile adoption together with lock dogs mechanism, such as a spring-loaded dog to form part of at least one releasable member, that is fully hidden in the tool body, directly under blades, enable a strong association together or a tool assembly and a tool body with no physical means to separate each other than using an access port and a release tool. In at least one embodiment, the tool assembly can be disassociated, such as, disassembled, by depressing the lock dogs through the access port that forms a service hole and using a release tool that is plugged during use of the system or that is external to the system.

The features of the system and tool assembly herein dramatically reduces lead time to manufacture, service, and maintain the system and tool assembly. Further, there are fewer long lead components in the final component assembly using such a system. This at least results in an increase in utilization or life of the system by removing consumable items from at least the tool body.

FIG. 1 is a schematic view of an embodiment of a system 100 for performing downhole run and/or retrieval operations, in accordance with embodiments of the present disclosure. The system 100 may include a rig 102 and a drill string 104 coupled to the rig 102. The rig may be over a terranean surface or a sea surface. However, other implementations of such a system may incorporate features of a method and system disclosed herein. The drill string 104 includes a downhole system or tool 128 at a proximal end that may be rotated to engage an inner diameter of a casing 126 or underground or earth formation 108 associated with a wellbore 110. In at least one embodiment, drill string 104 includes a downhole system or tool 128 at a proximal end that may be rotated to engage an inner diameter of a casing 126 that is in a subsea level or formation 108. This enables the downhole system or tool 128 to run or to retrieve features, such as wear bushings and nominal seat protectors in the casing 126 or the wellbore 110. Although a spacing is illustrated between a casing 126 and a wellbore 110, at its sidewall 112, this spacing is illustrative only and may not exist in the downhole environment 124.

The drill string 104 can be formed from one or more tubulars that are mechanically coupled together (e.g., via threads, specialty couplings, or the like). As shown, the wellbore 110 includes a borehole sidewall 112 (e.g., sidewall) and an annulus 114 between the wellbore 110 (or between a casing 126) and the drill string 104 or a wireline. Moreover, a bottom-hole assembly (BHA) 116 is positioned at the end of the drill string 104. In the example shown, the BHA is positioned at the bottom of the wellbore 110 or casing 126. The BHA 116 may include a drill bit 106, a drill collar 118, stabilizers 120, or the like.

In at least one embodiment, the system 100 includes various tools 122, such as logging tools and surface logging tools, which may be utilized to obtain measurements from the formation 108. The logging tools, which are part of the BHA, include, for example, logging while drilling tools and may include nuclear tools, acoustic tools, seismic tools, magnetic resonance tools, resistivity tools, sampling tools, and the like.

Figure 2A:
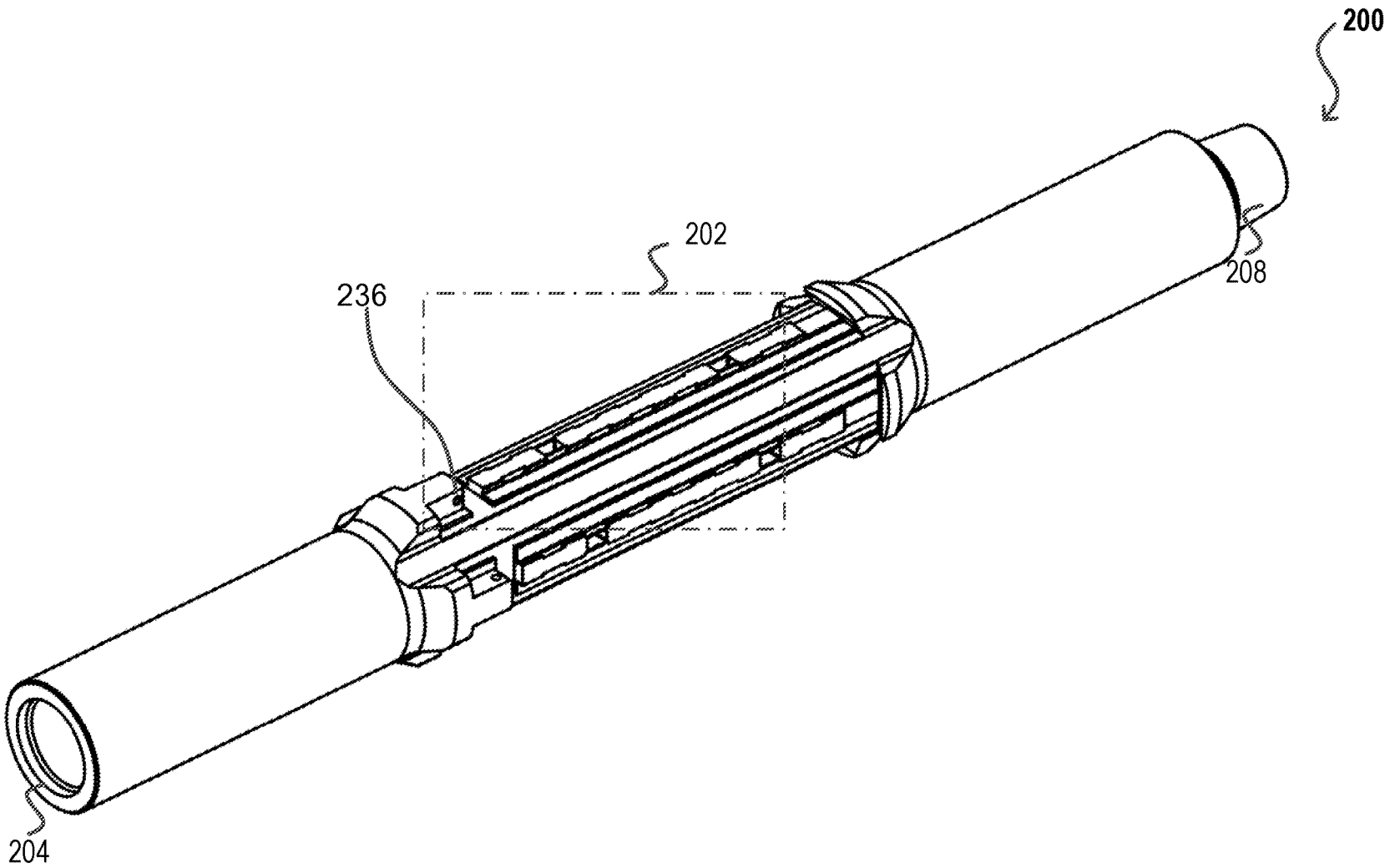
FIG. 2A illustrates a tool body for performing downhole run and/or retrieval operations, according to at least one embodiment.

FIG. 2A illustrates a tool body 200 for performing downhole run and/or retrieval operations, according to at least one embodiment In at least one embodiment. In at least one embodiment, the tool body 200 is part of a system for downhole run and/or retrieval operations of features. The tool body 200 includes an interfacing profile 202. The tool body 200 may be associated with other tools within a BHA, as described with respect to FIG. 1. For example, threads or other mating features at a proximal end 204 of a tool body 200 allows for such mating on one side, with a distal end 208 open or further association with other tools or terminated by an appropriate termination feature.

Figure 2B:
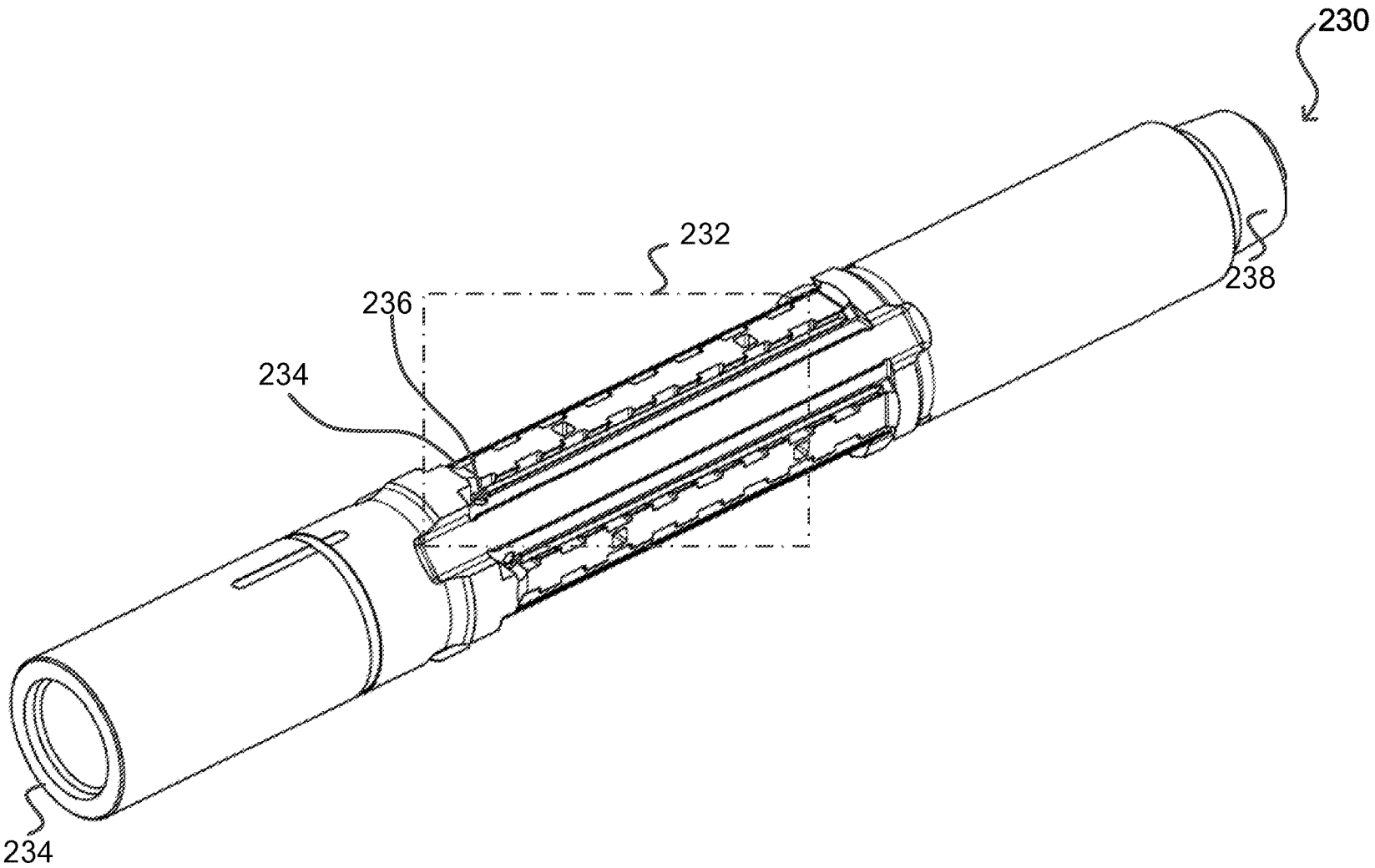
FIG. 2B illustrates another tool body for performing downhole run and/or retrieval operations, according to at least one embodiment.

FIG. 2B illustrates a tool body 230 for performing downhole run and/or retrieval operations, according to at least one embodiment In at least one embodiment. In at least one embodiment, the tool body 230 is part of a system for downhole run and/or retrieval operations of features. The tool body 230 includes an interfacing profile 232. The tool body 230 may be associated with other tools within a BHA, as described with respect to FIG. 1. For example, threads or other mating features at a proximal end 234 of a tool body 230 allows for such mating on one side, with a distal end 238 open or further association with other tools or terminated by an appropriate termination feature.

In at least one embodiment, differently than the embodiment in FIG. 2A, the tool body 230 in FIG. 2B includes a neck section for the interfacing profile 232 and includes passthrough holes 236 on the tool body 230 for a locking feature. The locking feature may be heads of a screw or bolt (as further described in FIG. 5B) to provide a surface for a matching shoulder of a tool assembly. This may be different than a shoulder interface described with respect to the embodiment in FIG. 5A using the tool body of FIG. 2A.

Figure 3:
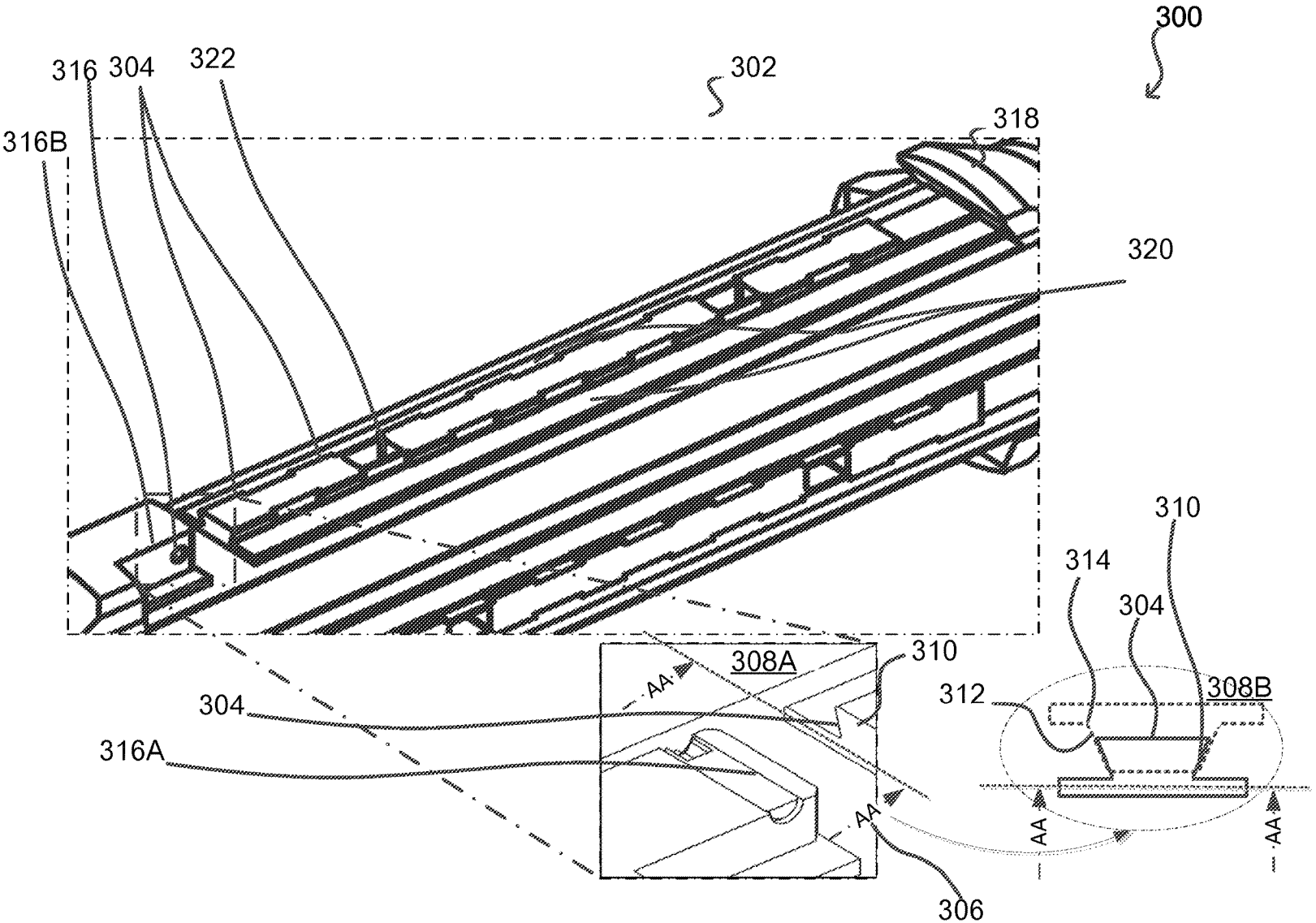
FIG. 3 illustrates details of a tool body for performing downhole run and/or retrieval operations, according to at least one embodiment.

FIG. 3 illustrates details 300 of a tool body, such as a tool body 200 in FIG. 2, for performing downhole run and/or retrieval operations, according to at least one embodiment. Such details 300 may be on an interfacing profile 302 on at least one side of a tool body, which is also referenced as an interfacing profile 202 of a tool body 200 in FIG. 2. Further, such details 300 may be replicated on multiple sides of a tool body, but is illustrated in detail to one side at least. Details 300 include a releasable member pocket 322 for including a releasable member, such as a spring-loaded dog. In at least one embodiment, the releasable member pocket 322 allows a releasable member to be seated therein in only one fit so that it cannot be improperly installed.

The interfacing profile 302 includes a number of raised or inset dovetail features 304 to form part of the interfacing profile. FIG. 3 also illustrates that the dovetail features 304 include a dovetail profile 310 when each dovetail feature 304 is viewed in a cross-sectional view AA 306, as illustrated in callout 308B. A matching dovetail profile 312 of a tool assembly, such as described further in FIGS. 5-7C, allows multiple matching inset or raised dovetail features 314 of the tool assembly to form part of an inner matching profile of the tool assembly, as illustrated in at least these figures. Furthermore, while dovetail features of the tool body is illustrated as raised dovetail profiles to mate with inset dovetail profiles of the tool assembly, it is also possible to provide the inset dovetail profiles in the tool body to mate with raised dovetail profiles on the tool assembly.

The dovetail feature 304 of the tool body also enables a railing feature 320, at least on its sides, that is part of the interfacing profile 302. The matching inset or raised dovetail features 314 of the tool assembly also enables a seating feature (such as, a seating feature 652 in FIG. 6B) that is adjacent to the dovetail profile and is part of the inner matching profile (such as, an inner matching profile 654 illustrated in FIG. 6B). The railing feature and the seating feature are so that the tool assembly can slide over the tool body to be locked in place as part of an association between the tool assembly and the tool body.

Figure 5A:
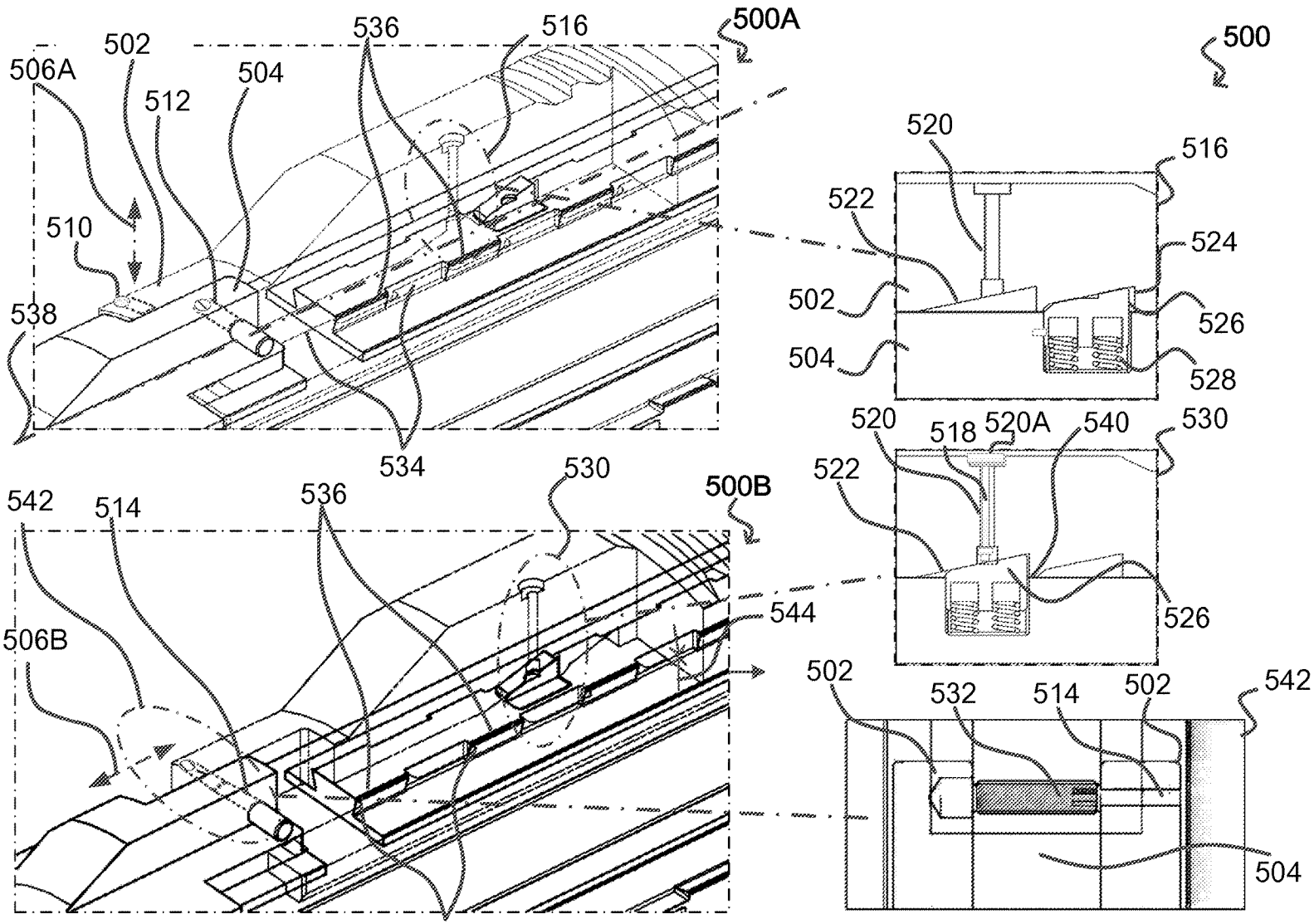
FIG. 5A illustrates association details of a tool assembly with a tool body for performing downhole run and/or retrieval operations, according to at least one embodiment.

In at least one embodiment, a retention feature 316 allows for a retention screw, such as illustrated in and discussed with respect to FIG. 5A, within a shoulder 316B, to further associated together with a surface having a corresponding feature of the tool assembly with the tool body. The retention feature 316 can be one of multiple passthrough features providing a passthrough hole in the tool assembly and the tool body for the retention screw to be screwed through. FIG. 3 also illustrates, in callout 308A, a cutaway 316A of a retention feature through with a retention screw may be passed to retain a position of the tool assembly with the tool body when they are associated together. However, the retention feature and retention screw may be part of other retention aspects allowed between the tool assembly and the tool body. The retention feature 316 having the passthrough hole, together with the retention screw, can provide a second lock between the tool assembly and the tool body that is different from a first lock provided by the releasable member pocket 322 including a releasable member after axial sliding between the tool assembly and the tool body.

In at least one embodiment, while the retention feature and the retention screw allow further association of the tool assembly with the tool body, there are no downhole related forces experienced with such a retention feature and retention screw. Instead, torque or rotational load is experienced at the interface profile 302 of the tool body and the inner matching profile of the tool assembly. Pertinently, when dovetail features are used, the torque or rotational load may be experienced in these features. FIG. 3 also illustrates a shoulder 318, as part of the interface profile 302, on the tool body. The shoulder 318 allows a matching shoulder or surface of a tool assembly to rest once the tool assembly is slid over the tool body and locked in place as part of its association with the tool body. The shoulder 318 also bears an axial impact during a run and/or retrieval operations in a downhole environment. This shoulder 318 and its associated surface is a second shoulder-surface interface that is at an opposite end from a first shoulder-surface interface.

Figure 4:
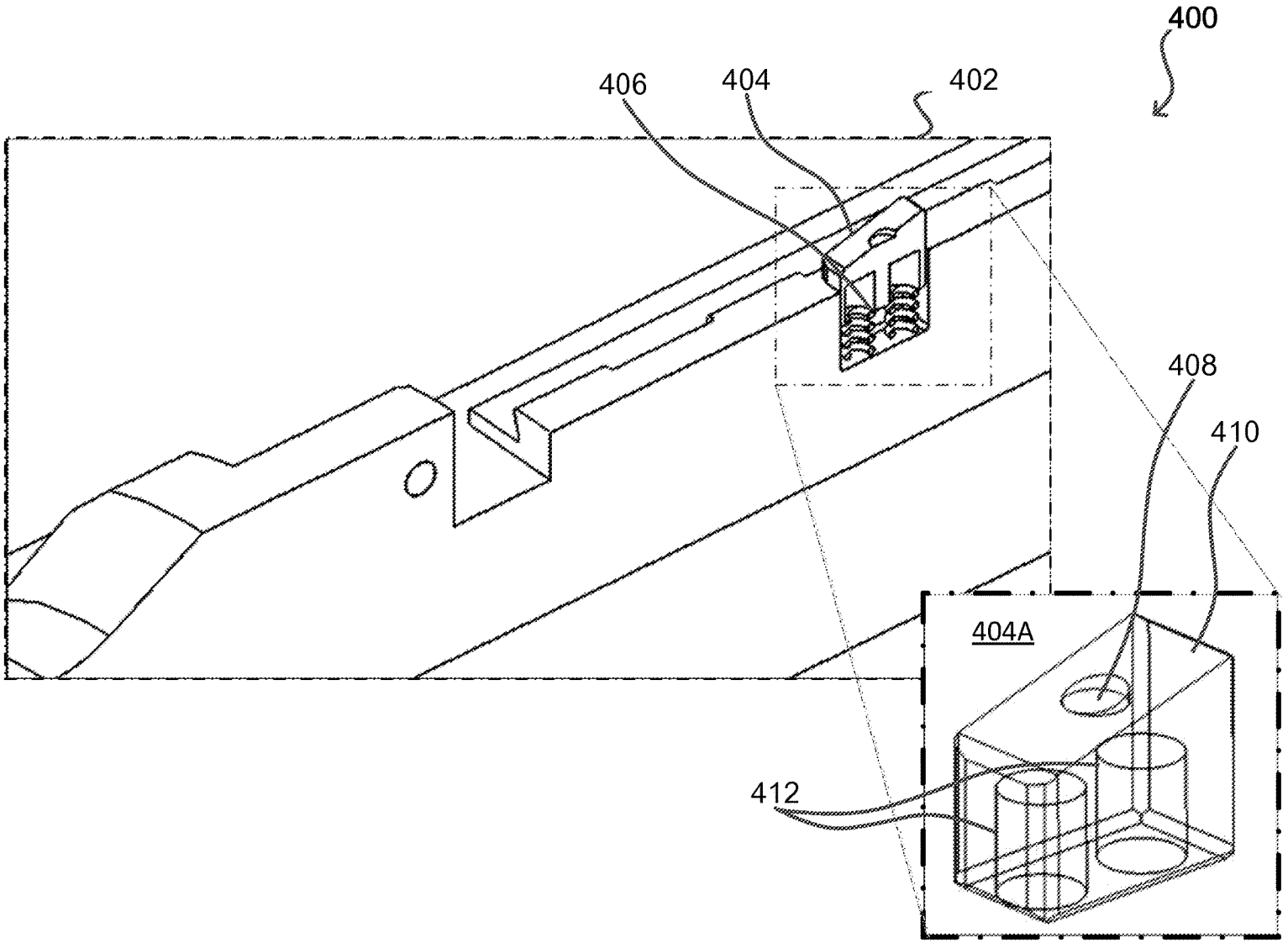
FIG. 4 illustrates further details of a tool body for performing downhole run and/or retrieval operations, according to at least one embodiment.

FIG. 4 illustrates further details 400 of a tool body for performing downhole run and/or retrieval operations, according to at least one embodiment. In FIG. 4, the details 400 is illustrated in a lengthwise section of the tool body. For example, the further details 400 include at least one releasable member 404 that may be provided on the interface profile 402 of the tool body. The releasable member is associated with the tool body using springs 406 within provided areas or spring pockets 412 of the releasable member.

In at least one embodiment, an angled indentation of a tool assembly is provided to receive the releasable member 404. For example, as the tool assembly slides axially over the interface profile 402, a flat surface (such as surface 540 in FIG. 5A) adjacent to the angled indentation (such as angled indentation 522 of FIG. 5A) of the tool assembly first depresses the releasable member 404; but as the angle indentation moves over the releasable member 404, in a second action, it allows the releasable member 404 to fit snugly within the angled indentation, as illustrated in part in at least FIG. 5A. This provides a position lock for the association between the tool assembly and the tool body. This may be a first lock between the tool assembly and the tool body.

FIG. 4 also illustrates, in a callout 404A, an indentation or depressed pocket 408 that may be part of a release feature between the tool assembly and the releasable member of the tool body. For example, the indentation 408 allows thereon a release tool to press against the releasable member of the tool assembly. An access port of the tool assembly (such as, an access port 520 in a tool assembly 502 in FIG. 5A) may be a pluggable access port forming another part of the release feature. The access port of the tool assembly can receive a plug for closure of the access port to prevent inadvertent pressure on the releasable member 404.

In at least one embodiment, the access port also prevents entry of any debris or other downhole matter into the interface between the tool assembly and the tool body. With a plug removed, the access port of the tool assembly can also receive a release tool to depress the releasable member for disassociating the tool assembly from the tool body. In at least one embodiment, the access port already has a release tool within it with a depressed and threaded plug. The depressed and threaded plug prevents inadvertent pressure on the release tool. Further, threading, or causing downward pressure in other manners, of the depressed and threaded plug causes the access tool to move down into the releasable member. These aspects allow the releasable member to be depressed after removal of a plug or using the plug in the pluggable access port.

The access tool pushed into the releasable member 404 can cause the releasable member to depress and release from the angled indentation if simultaneous pulling or pushing action is axially applied to move the tool assembly against the tool body. For example, with the releasable member 400 depressed and with the tool assembly moved axially relative to the tool body, the tool assembly disassociates from the tool body.

FIG. 5A illustrates association details 500 of a tool assembly 502 with a tool body 504 for performing downhole run and/or retrieval operations, according to at least one embodiment. FIG. 5A illustrates the association details 500 in a partly longitudinal cross-section view for the tool assembly 502 overlying surface detail view of a tool body 504. The tool assembly 502 has an outer tool profile, as discussed in at least FIGS. 6A, 6B, and 7B, has an indentation 522, such as an angled indentation, to receive at least one releasable member 526, and has an inner matching profile 534 to be associated with the interfacing profile 536 of the tool body. In at least one embodiment, the releasable member 526 is a spring-loaded dog. The association details 500 also includes a landed association details 500A and a locked association details 500B. In at least one embodiment, the releasable member 526 is provided to absorb radial loading on the system having the tool assembly and tool body during a run and/or retrieval operation.

In at least one embodiment, the tool assembly 502 can be unlocked to be changeably associated with the tool body 504 for use in the downhole run and/or retrieval operations of features. In one example, in the landed association details 500A, the tool assembly 502 is landed or seated (such as, by a movement in a tangential direction 506A relative to an axis 538 of the tool body) over the tool body 504. In one example, in the locked association details 500A, the tool assembly 502 is moved along an away axial direction 506B relative to the axis 538 of the tool body. In at least one embodiment, an away axial direction 506B is toward a bottom or distal end of the tool body. Between the association details 500A, B of FIG. 5A, the narrow dovetail features of the inner matching profile 534 is illustrated as moved (comparing 500A to 500B) distally over dovetail features of the interfacing profile 536 of the tool body.

In at least one embodiment, when it is landed, the tool assembly 502 provides an indentation or guide profile 524 to accept the releasable member 526 during landing association between the tool assembly 502 and the tool body 504, so that the tool assembly 502 sits flush with the tool body 504 prior to a locking association. This is illustrated in the landed association details 500A, with a sideview cutout of an area 516 to provide further clarity to the landing association details. When the tool assembly 502 is moved in an away axial direction, towards a distal end of the tool body, a flat surface 540 of the tool assembly 502 depresses the releasable member 526 against the heavy duty springs 528. At the same time, matching dovetail features on the inner matching profile 534 of the tool assembly 502 start to associate with dovetail features of the interfacing profile 536 of the tool body.

As the tool assembly 502 is moved further axially, the releasable member 526 passes the flat surface 540 and springs into the angled indentation 522, while the matching dovetail features and the dovetail features become fully associated together. The springs 528 press the releasable member 526 against the tool assembly 502 as the dovetail features and the matching dovetail features are engaged and held in place. This causes the tool assembly 502 to be locked with the tool body 504. This is illustrated in the locked association details 500B, with a sideview cutout of an area 530 of FIG. 5A that provides more clarity of the locking association details.

FIG. 5A further illustrates a passthrough feature 514 (partly in dotted lines to illustrate that it is within the tool and partly formed of an alignment of a first passthrough hole 510 at a proximal end of the tool assembly 502) and a second passthrough hole 512 at a proximal end of the tool body 504 provide a first shoulder-surface interface 542 for a second lock using a retention screw, a bolt, a J-slot, or another spring-loaded dog. This passthrough hole 514 forms a retention feature that allows for a retention screw 532 therethrough. This is illustrated in a cross-sectional cutout of an area 6 in FIG. 5A to provide clarity of such features. The retention screw 532 is only used once the tool assembly 502 is in a locked association with the tool body 504. In at least one embodiment, the retention screw 532 is always within the retention feature but may be screwed to move into an engagement with the tool assembly. FIG. 5A also illustrates an access port 520 that is a hole in a tool assembly 502 and that is located over the angled indentation 522 of the tool assembly 502. The access port 520 includes or can accept a release tool 518 to cause disassociation, in part, of the tool assembly 502 from the tool body 504.

In at least one embodiment, for disassociation of the tool assembly 502 from the blade body 504, the retention screw 532 may be first removed. Then, the release tool 518 may be used with an external force or pressure applied to the release tool 518, through the access port 520, so as to depress the releasable member 526 against heavy duty springs 528. In a depressed position, the releasable member 526 does not engage the angled indentation 522. With the releasable member 526 depressed, the tool assembly 502 may be pulled axially 506B towards a proximal end of tool body 504 or pushed axially away from the distal end of the tool body 504. As a result, the dovetail features of the tool assembly and of the tool body allow axial sliding against each other with the railing feature and the seating feature providing alignment for such movement. Once the dovetail features are disassociated, the tool assembly 502 may be removed by a tangential action 506A, away from an axis 538 of the tool body 504. Then a new tool assembly may be attached to the tool body 504.

In at least one embodiment, there may be multiple such releasable members 526 for each tool assembly 502. As such there may be multiple access ports and release tools for each access port. In at least one embodiment, there may be multiple tool assemblies 502 located on other surfaces of the tool body 504 so that there may be at least tool assemblies on opposing sides of the tool body. For example, there may be four tool assemblies on a tool body with each tool assembly having a counterpart tool assembly on an opposing surface of the tool body.

Figure 5B:
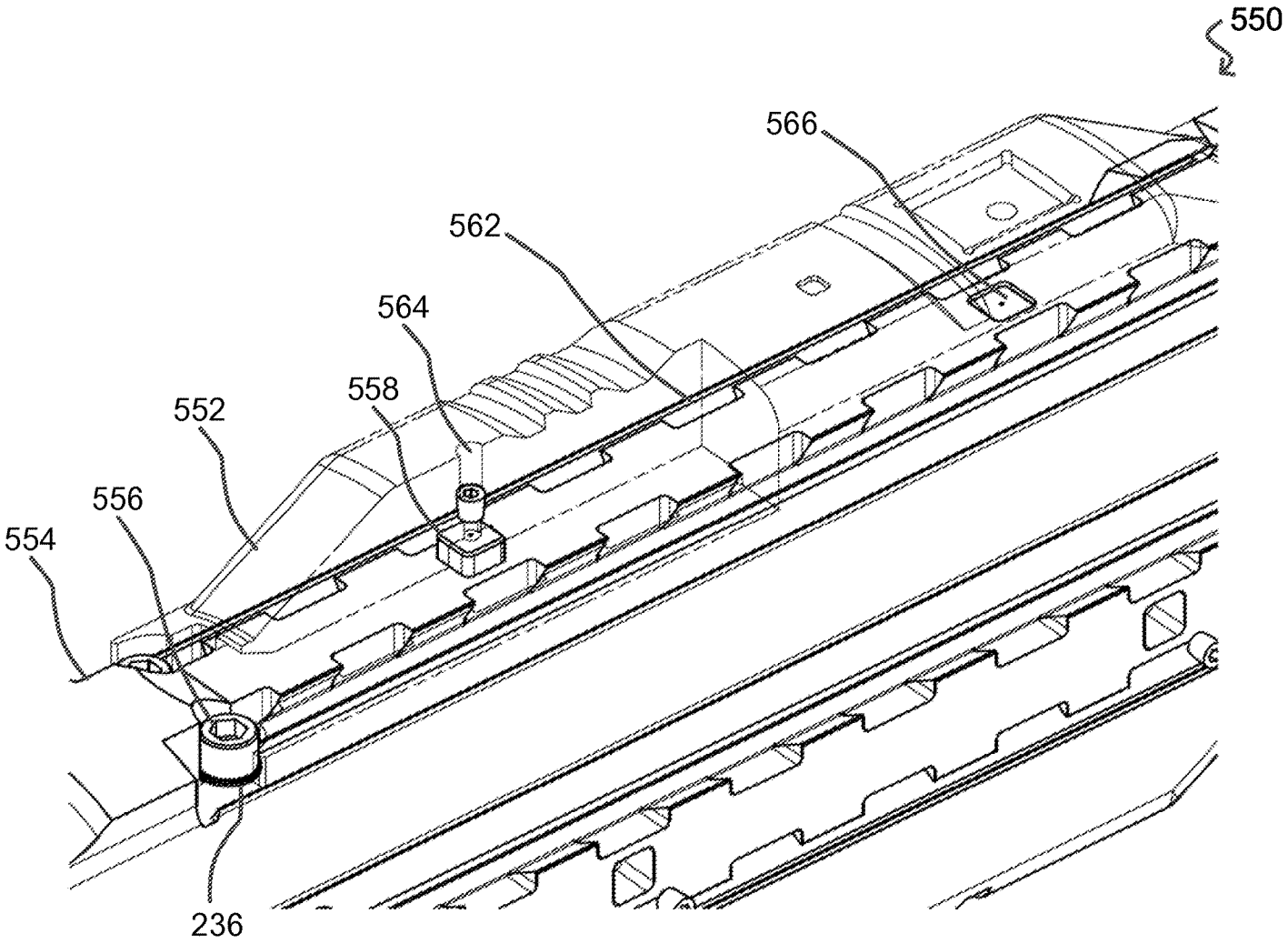
FIGS. 5B and 5C illustrate other association details of another tool assembly with a tool body for performing downhole run and/or retrieval operations, according to at least one embodiment.
Figure 5C:
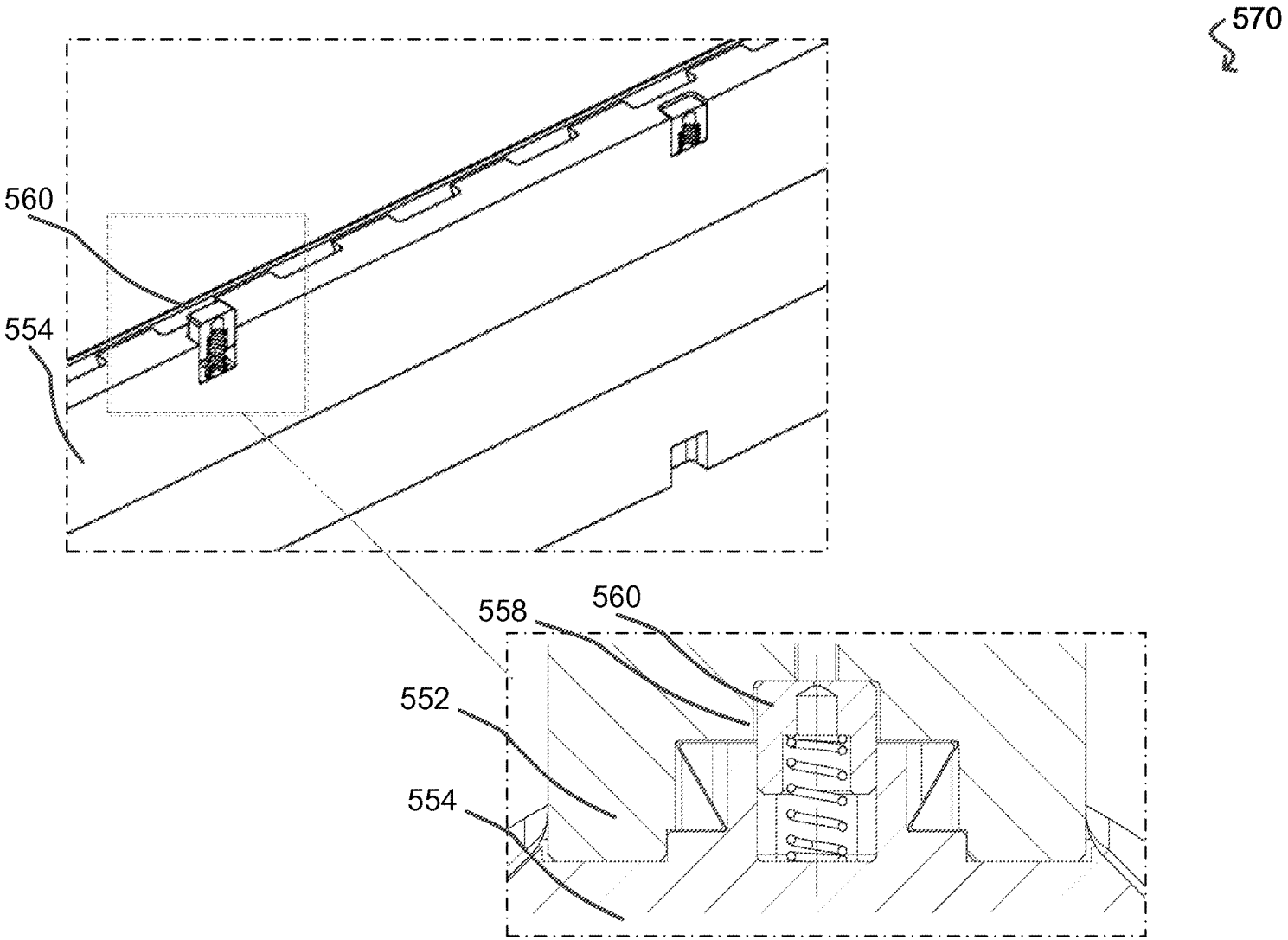

FIGS. 5B and 5C illustrate other association details 550; 570 of a tool assembly 552 with a tool body 554 for performing downhole run and/or retrieval operations, according to at least one embodiment. FIG. 5B illustrates the association details 550 in a partly longitudinal cross-section view for the tool assembly 552 overlying surface detail view of a tool body 554. The tool assembly 552 has an outer tool profile, as discussed in at least FIGS. 6C, 6D, and 7C, has an indentation 558, such as a square indentation, to receive at least one releasable member 560 (in FIG. 5C), and has an inner matching profile 562 to be associated with the interfacing profile 232 of the tool body 554; 230.

The tool assembly 552 includes the inner matching profile 564 to be associated with the interfacing profile 232 and to allow axial sliding for a first lock of the tool assembly to the tool body. The first lock or locking feature, in one example, may be enabled by a releasable member 560, such as a spring-loaded dog, which can perform in the manner described with respect to the embodiment in FIG. 5A. A second lock or locking feature is provided for the tool assembly and the tool body at least by a shoulder-surface interface between the tool assembly and the tool body provided by a retention feature in a passthrough feature, which is described with respect to FIG. 7C.

For example, a head or other part 556 of retention features, such as a screw or bolt, when placed through a passthrough hole 236 that forms a retention feature, provides the second lock. This further associates together the tool assembly and the tool body. The retention feature can be one of multiple passthrough features providing a passthrough hole in the tool assembly and the tool body for the retention screw to be screwed through. However, the retention feature and retention screw may be part of other retention aspects allowed between the tool assembly and the tool body. The retention feature having the passthrough hole, together with the retention screw, can provide a second lock between the tool assembly and the tool body that is different from a first lock provided by the releasable member pocket 566 including a releasable member 560 after axial sliding between the tool assembly and the tool body. Therefore, the tool assembly is changeably associated with the tool body for use in the downhole operations.

In at least one embodiment, as illustrated in FIGS. 5A-5C, a gap 544 is allowed between the tool assemblies and the tool body so that stress caused by bending of the tool body can be withstood by the system and allowed in the gap 544. Further, like the case of FIG. 5A, in FIGS. 5B, 5C, an access port for a tool assembly (such as, an access port 564 in a tool assembly 552 in FIG. 5B) may be a pluggable access port forming another part of the release feature. The access port of the tool assembly can receive a plug 520A for closure of the access port, but a tool to thread a provided screw can be used to pressure the releasable member 560 against its spring and away from the tool assembly 552 to allow the tool assembly 552 to slide over the tool body 554 to be disassociated and replaced.

Figure 6A:
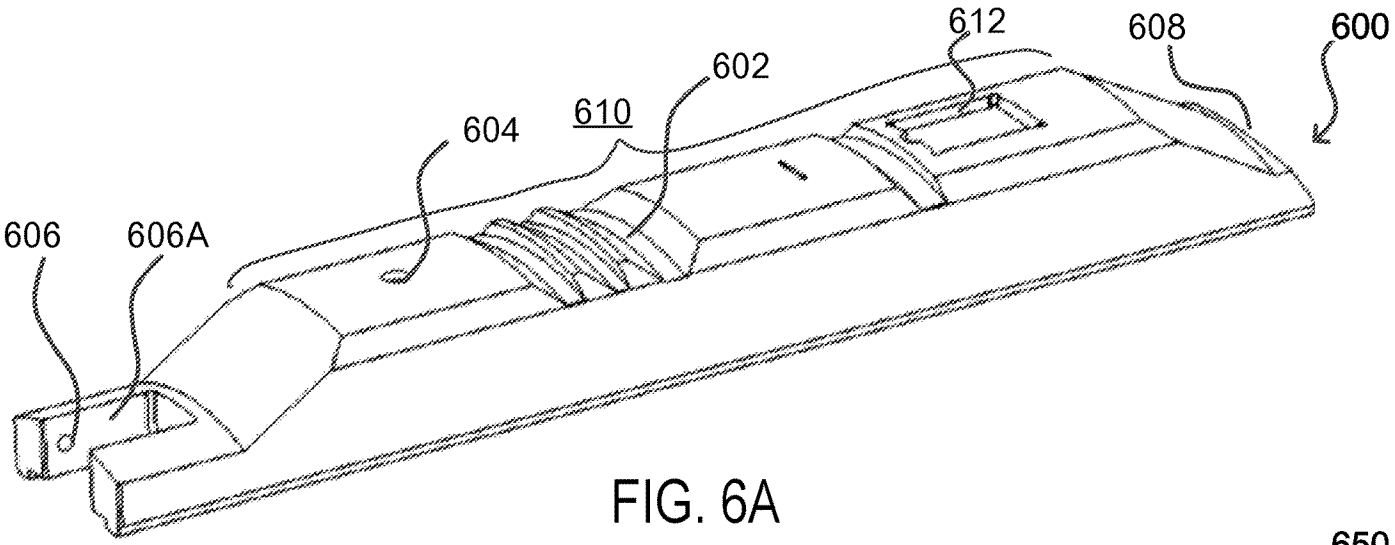
FIGS. 6A, 6B, 6C, 6D, 7A, 7B, and 7C illustrate outer profile and inner profile details of at least two different tool assemblies for performing downhole run and/or retrieval operations, according to at least one embodiment.
Figure 6B:
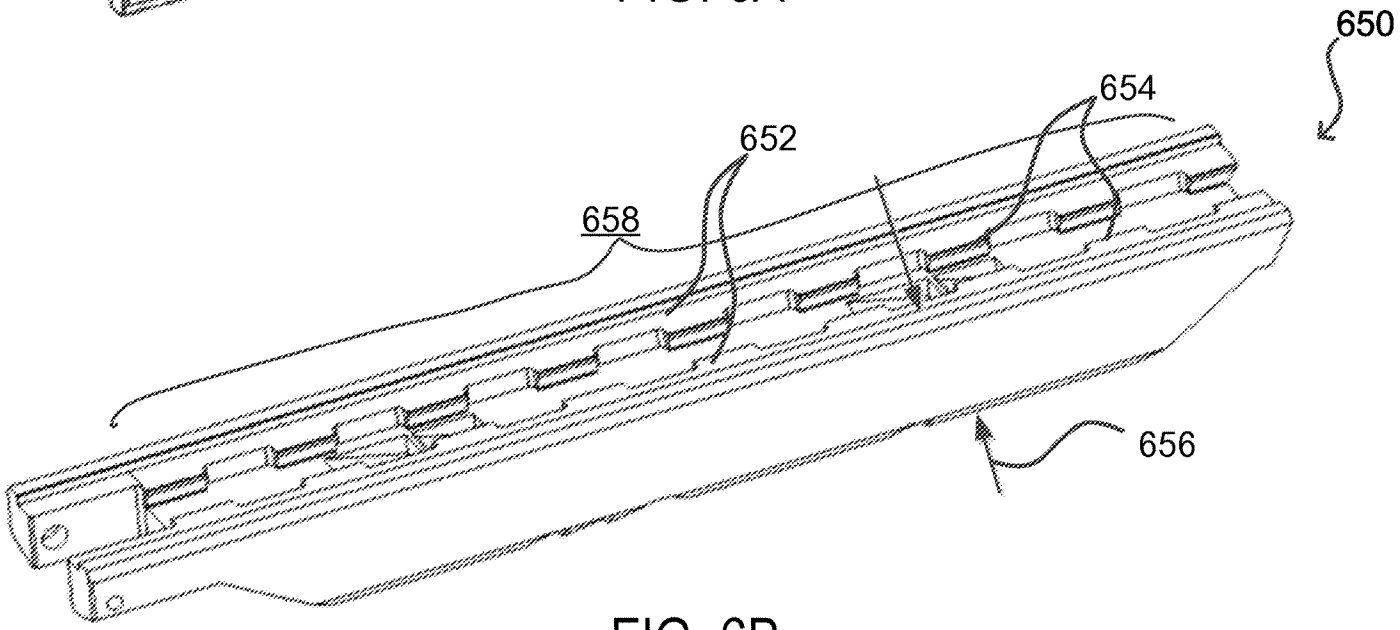

FIGS. 6A, 6B, 7A, 7B illustrate outer and inner profile details 600, 650, 700, 750 of at least two different tool assemblies 600, 650; 700; 750 for performing downhole run and/or retrieval operations, according to at least one embodiment. FIG. 6B may be an illustration of an underside of a tool assembly of FIG. 6A or may be of different tool assembly than in FIG. 6A. In at least one embodiment, FIGS. 6A, 6B illustrate a passthrough hole 606 of a passthrough feature at a first surface 606A (to be part of a first shoulder-surface interface) and a second surface 608 of a second shoulder-surface interface, in a system having a tool assembly and a tool body. FIGS. 6A, 6B also illustrate that the tool assembly has a determined thickness 656 so that, when associated with a tool body, the tool assembly 600, 650 can reach a determined internal diameter of a wellbore or casing in which it is applied for run and/or retrieval operations.

In at least one embodiment, the passthrough hole 606 of the tool assembly, when aligned with another passthrough hole that is on a tool body, forms a retention feature for a retention screw or other fastener therethrough. The alignment between the passthrough holes to form the retention feature is apparent in a locked association that is first enabled between the tool assembly and the tool body by sliding the tool assembly axially over the tool body.

Further, the shoulder-surface interface between the tool assembly and the tool body may be enabled as part of an association and part of a disassociation between the tool body and the tool assembly. The shoulder-surface interface is provided when the tool assembly is moved axially relative to the tool body by sliding the tool assembly axially over the tool body to a locked association between the two. The surface 608 of the shoulder-surface interface is a bottom surface of the tool assembly, while the shoulder is a bottom shoulder of the interface profile on the tool body (such as, a bottom shoulder 318 of an interface profile 302 in FIG. 3).

FIGS. 6A, 6B illustrate that a tool assembly 600, 650 includes an outer tool profile 610. The outer tool profile 610 may be formed of multiple blades 602 that are angled in a direction from a distal end to a proximal end of the tool assembly 600, 650. The outer tool profile 610 also includes an area 612 for a run aspect to be positioned. The run aspect may be WBs or NSPs to be landed by positioning such WBs or NSPs in the area 612 and releasing it into an appropriate part of the borewell or casing hanger. FIG. 6B also illustrates that its matching dovetail features 654 of the tool assembly 600, 650, to the dovetail features of a tool body, are inset dovetail features. In at least one embodiment, the matching dovetail features of the tool assembly 600, 650 may be raised dovetail features when the to the dovetail features of a tool body are inset features, so that mating of the dovetail features and the matching dovetail features is possible. Further, FIG. 6B illustrates a seating feature 652 that is located at least on its sides, that is part of the inner matching profile 658.

Figure 6C:
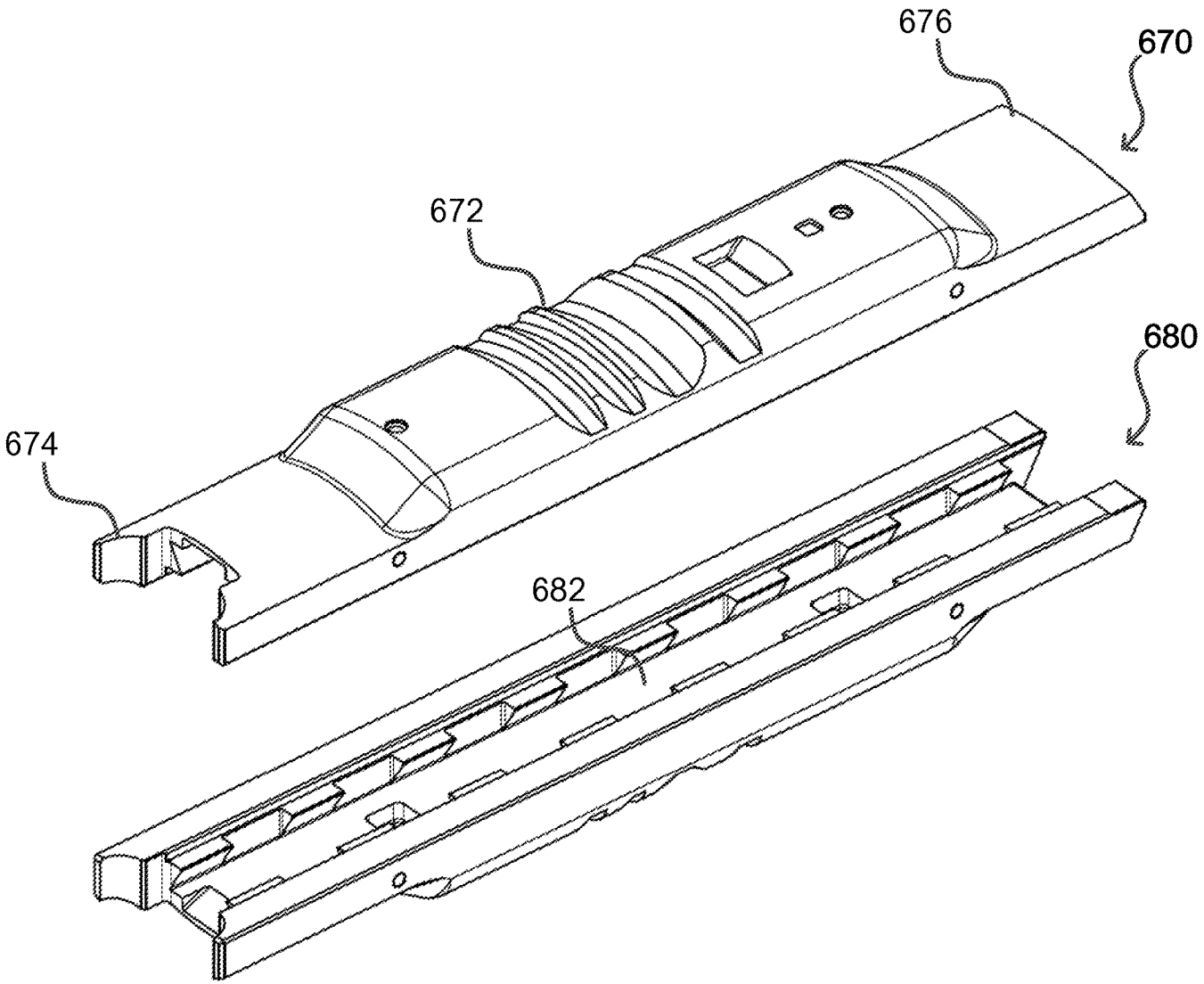
Figure 6D:
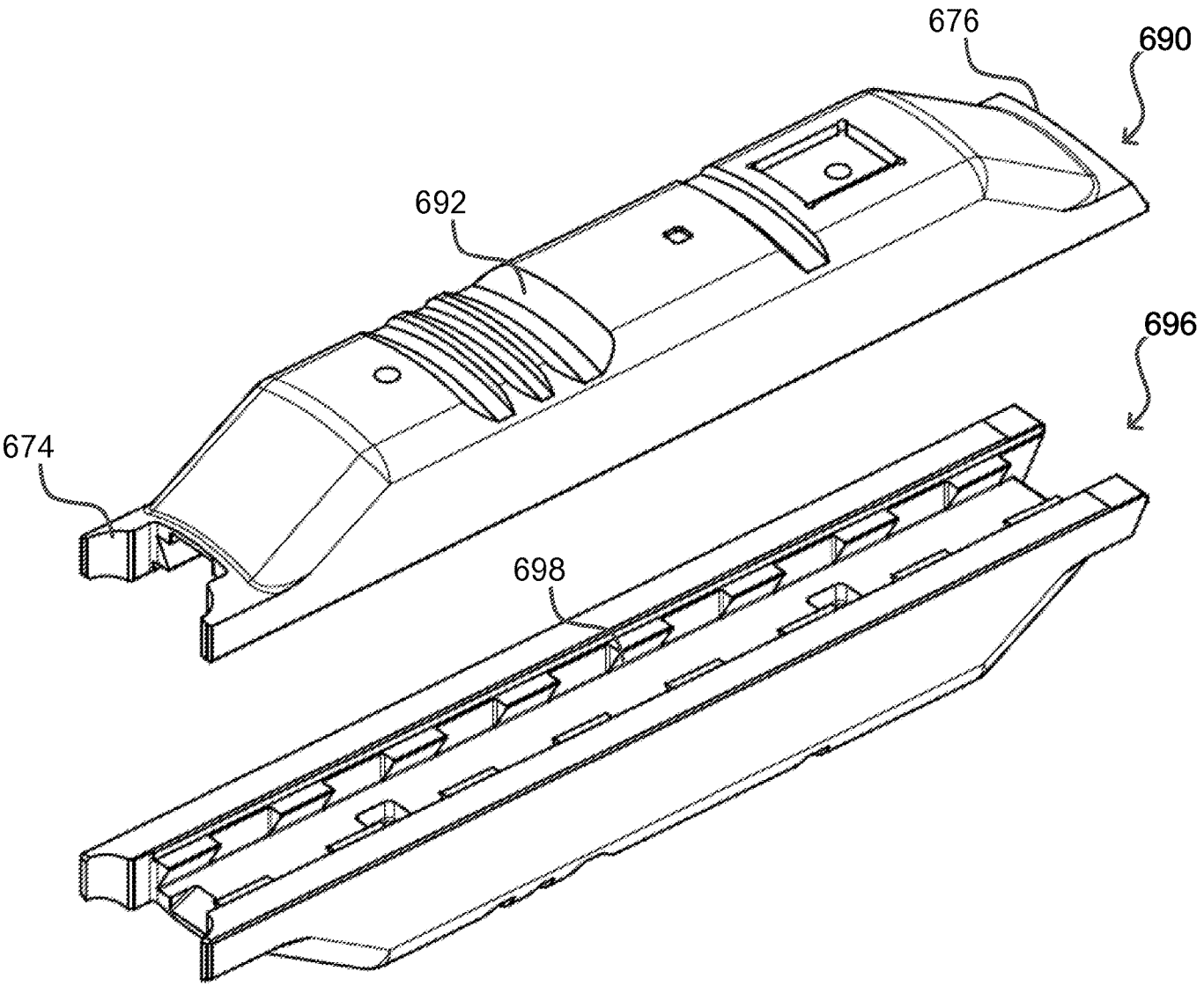

FIGS. 6C and 6D illustrate outer and inner profile details 672, 682 of at least two different tool assemblies 670, 680 for performing downhole run and/or retrieval operations, according to at least one embodiment. FIG. 6B may be an illustration of an underside of a tool assembly of FIG. 6A or may be of different tool assembly than in FIG. 6A. In at least one embodiment, differently than a passthrough hole, FIGS. 6C, 6D illustrate multiple shoulder-surface interfaces. For example, first shoulder or surface features 674 enable contact of the tool assembly 670 with a shoulder or surface of a screw head or bolt 556 (in FIG. 5B, which can used to as an external retention screw instead of the retention screw 532 that is interiorly placed in FIG. 5A). A second surface 676 of the multiple shoulder-surface interfaces in the system having a tool assembly and a tool body allows contact with a shoulder of a tool body 554. This allows the tool assembly to be position and then locked in position by at least the screw of the first shoulder-surface interface.

FIGS. 6C, 6D also illustrate that the tool assembly 670; 680 has a determined thickness (such as described with respect to FIGS. 6A, 6B) so that, when associated with a tool body, the tool assembly 670; 680 can reach a determined internal diameter of a wellbore or casing in which it is applied for run and/or retrieval operations. In at least one embodiment, the first shoulder-surface interface forms a retention feature using a retention screw or other fastener therethrough the provided hole of the tool body 670; 680.

Figure 7A:
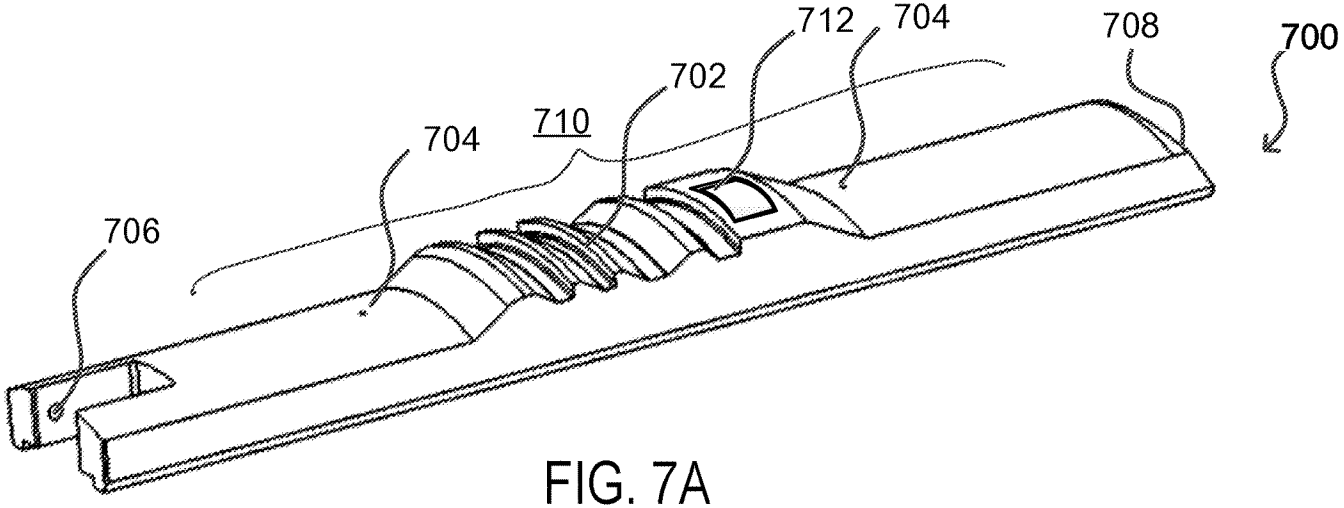
Figure 7B:
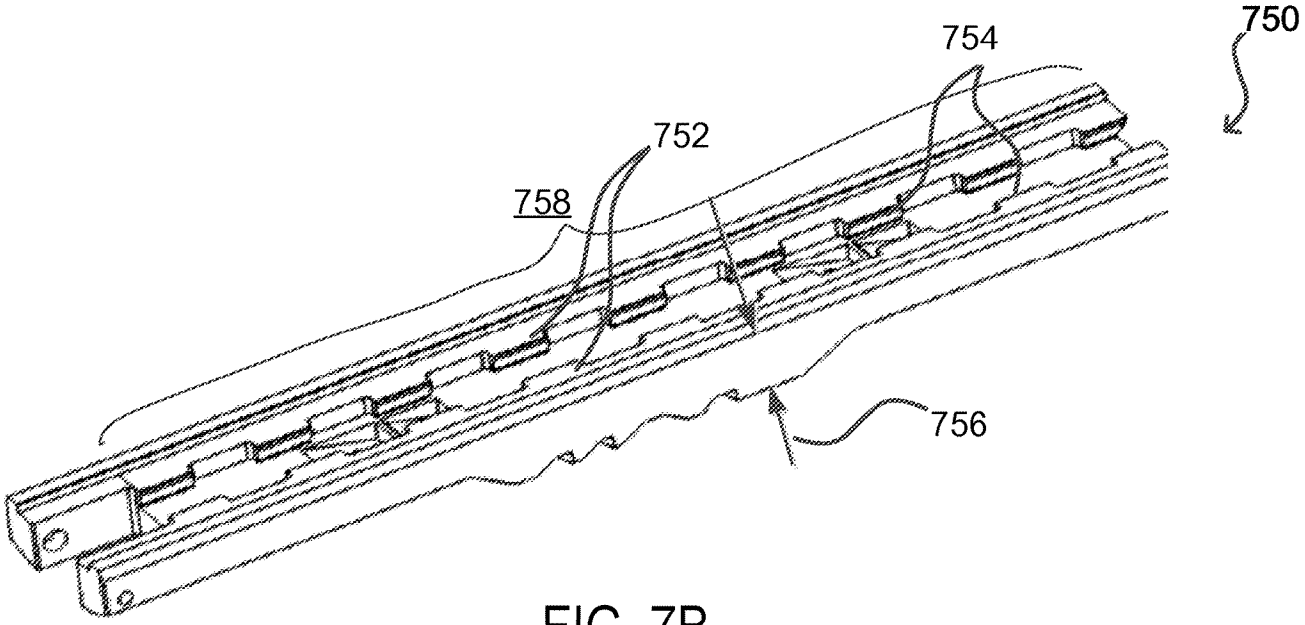

FIGS. 7A, 7B illustrate that a tool assembly 700, 750 includes an outer tool profile 710 that is of different thickness than a tool assembly 600, 650 in FIGS. 6A, 6B. For example, the thickness 756 of a tool assembly 700, 750 represents a different sizing or dimension of the tool assembly (than a thickness 656 of a tool assembly 600, 650) so that it can reach a different internal diameter of a wellbore or casing in which it is applied for run and/or retrieval operations. Pertinently, the internal diameter of a wellbore or casing for which a tool assembly 700, 750 of FIG. 7A, 7B is used is a lesser than an internal diameter of a wellbore or casing for which a tool assembly 600, 650 of FIGS. 6A, 6B is used.

As a wider internal diameter of a wellbore or casing requires the tool assembly to reach further from a tool body and, a thicker tool assembly, as in FIG. 6A, 6B is appropriate. In at least one embodiment, some sizes of a borehole or casing addressable by the tool or system herein include a downhole environment having an 18¾" internal diameter representing a size in a subsea wellhead; a 9⅝", 10¾" and 13⅜" representing internal diameters of different casing hangers.

FIGS. 7A, 7B illustrate that a tool assembly 700, 750 includes an outer tool profile 710. The outer tool profile 710 may be formed of multiple blades 702 that are angled in a direction from a distal end to a proximal end of the tool assembly 700, 750. The outer tool profile 710 also includes an area 712 for a run aspect to be positioned. The run aspect may be WBs or NSPs to be landed by positioning such WBs or NSPs in the area 712 and releasing it into an appropriate part of the borewell or casing hanger. FIG. 7B also illustrates that its matching dovetail features 754 of the tool assembly 700, 750, to the dovetail features of a tool body, are inset dovetail features. In at least one embodiment, the matching dovetail features of the tool assembly 700, 750 may be raised dovetail features when the to the dovetail features of a tool body are inset features, so that mating of the dovetail features and the matching dovetail features is possible. Further, FIG. 7B illustrates a seating feature 752 that is located at least on its sides, that is part of the inner matching profile 758.

In at least one embodiment, FIGS. 7A, 7B illustrate a passthrough hole 706 of a passthrough feature and a surface 708 of a shoulder-surface interface in a system having a tool assembly and a tool body. In at least one embodiment, the passthrough hole 706 of the tool assembly, when aligned with another passthrough hole of a tool body, forms a retention feature for a retention screw or other fastener therethrough. The alignment between the passthrough holes to form the retention feature is apparent in a locked association that is first enabled between the tool assembly and the tool body by sliding the tool assembly axially over the tool body.

Further, the shoulder-surface interface between the tool assembly and the tool body may be enabled as part of an association and part of a disassociation between the tool body and the tool assembly. The shoulder-surface interface is provided when the tool assembly is moved axially relative to the tool body by sliding the tool assembly axially over the tool body to a locked association between the two. The surface 708 of the shoulder-surface interface is a bottom surface of the tool assembly, while the shoulder is a bottom shoulder of the interface profile on the tool body (such as, a bottom shoulder 318 of an interface profile 302 in FIG. 3).

Figure 7C:
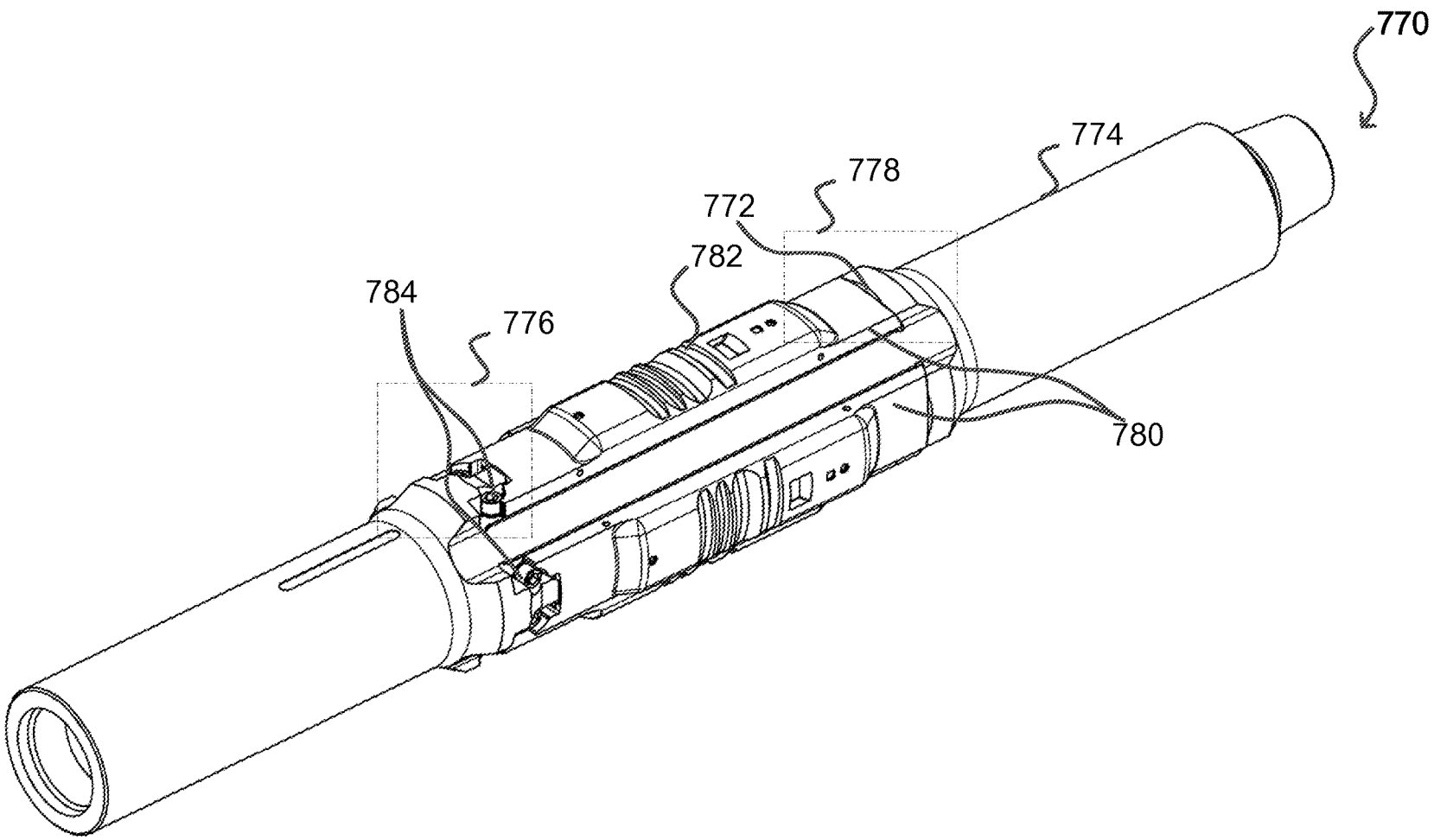

FIG. 7C illustrates a system 770 of tool assemblies 780 including an outer tool profile 782 on tool body 774. The tool assemblies 780 may be as described in FIGS. 6C, 6D. Further, a first shoulder-surface interface 776 is enabled by the screw head or bolt head 784 between each tool assembly 780 and the tool body 774. The first shoulder-surface interface 776 may be enabled as part of an association and part of a disassociation between the tool body 774 and each tool assembly 780.

A second shoulder-surface interface 778 is at an opposite end from the first second shoulder-surface interface 776 and is provided when each tool assembly 780 is in a locked association with the axially relative to the tool body 774. The surface 772 of the second shoulder-surface interface 778 is a bottom surface 676 of each tool assembly 780, while the shoulder is a bottom shoulder 772 of an interfacing profile on the tool body 774. The second shoulder-surface interface 778 is provided by sliding the tool assembly axially over the tool body 774. The second shoulder-surface interface 778 may only stop further movement of the tool assembly against the tool body, but a first locking between the tool assembly and the tool body is enabled by a spring-loaded dog and a second lock is enabled by the first shoulder-surface interface 776.

In at least one embodiment, FIGS. 6A, 6B and 7A, 7B illustrate at least two different tool assemblies that are interchangeable for having different outer tool profiles 610, 710, but can be associated with the same tool body because of having the same inner matching profile 658, 758. Similarly, FIGS. 6C and 6D illustrate at least two different tool assemblies that are interchangeable for having different outer tool profiles 672, 692, but can be associated with the same tool body because of having the same inner matching profile 682, 698. Further, the different tool assemblies can have different thickness to reach different inner diameters of a borewell or a casing. In at least one embodiment, individual ones of the different tool assemblies can have different circumferential blades and blade types to access inner diameters of boreholes and casing hangers. For example, instead of tool assemblies of a same type that can be associated together on a tool body to represent a circumferential blade on a tool body, different fully circumferential tool assemblies, such as a sleeve having an outer tool profile and having an inner matching profile to be used with a same tool body can be provided. Such a sleeve format tool assembly can also be changeable and can have different circumferential blades for a tool body.

Figure 8A:
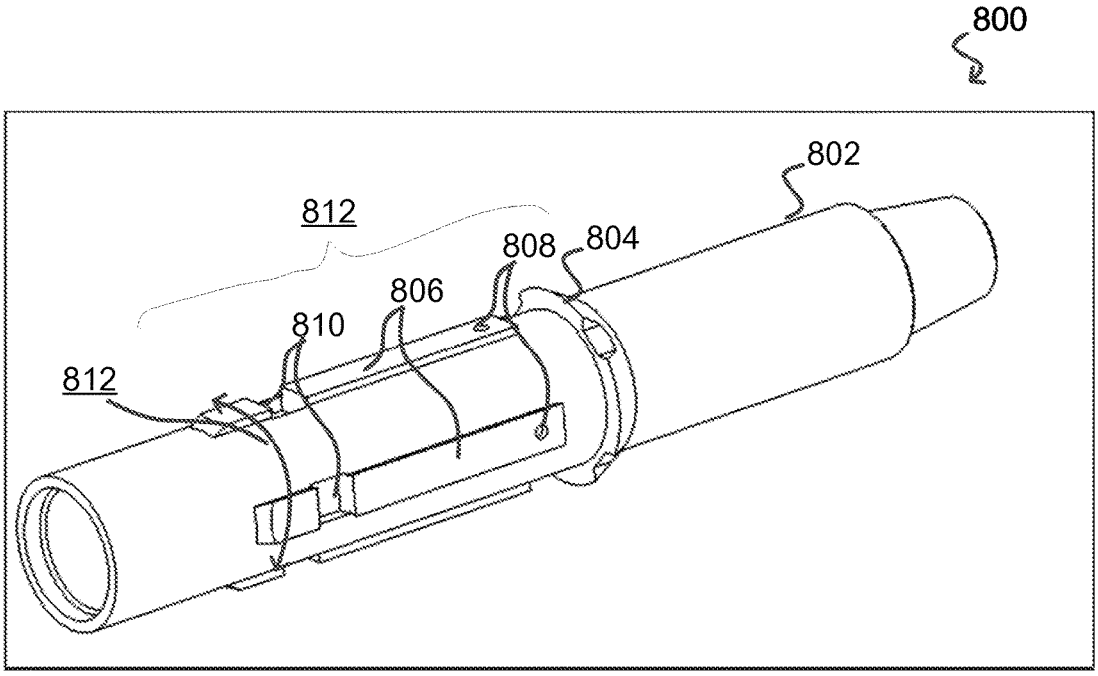
FIG. 8A illustrates alternate details of a tool body for performing downhole run and/or retrieval operations, according to at least one embodiment.

FIG. 8A illustrates alternate details 800 of a tool body 802 for performing downhole run and/or retrieval operations, according to at least one embodiment. The tool body 802 includes an interfacing profile 812 that is useful for different fully circumferential tool assemblies. However, the tool body 802 of FIG. 8A can also support association of different tool assemblies of a same type to each provided dovetail feature 806 of the interfacing profile 812. FIG. 8A also illustrates that an interfacing profile of a tool body may be axial that is parallel to an axis of a tool body 802 or may be circumferential about an axis of the tool body 802.

In at least one embodiment, one or more areas 810 may be provided for a releasable member to be associated with the tool body 802. Other types of retention features may be enabled by provided areas 808 in the tool body 802 as part of second locks for the tool assembly and the tool body. A shoulder 804 is also provided on the tool body 802 for interfacing with a surface 868 of the fully circumferential tool assemblies or of multiple tool assemblies to be associated together to form a circumferential blade. For example, a sleeve format tool assembly, as illustrated in FIG. 9A and described herein, can have fully circumferential blades in its outer tool profile without a need to associate together different tool assemblies of a same type as in FIGS. 6A, B or in FIGS. 7A, B.

Figure 8B:
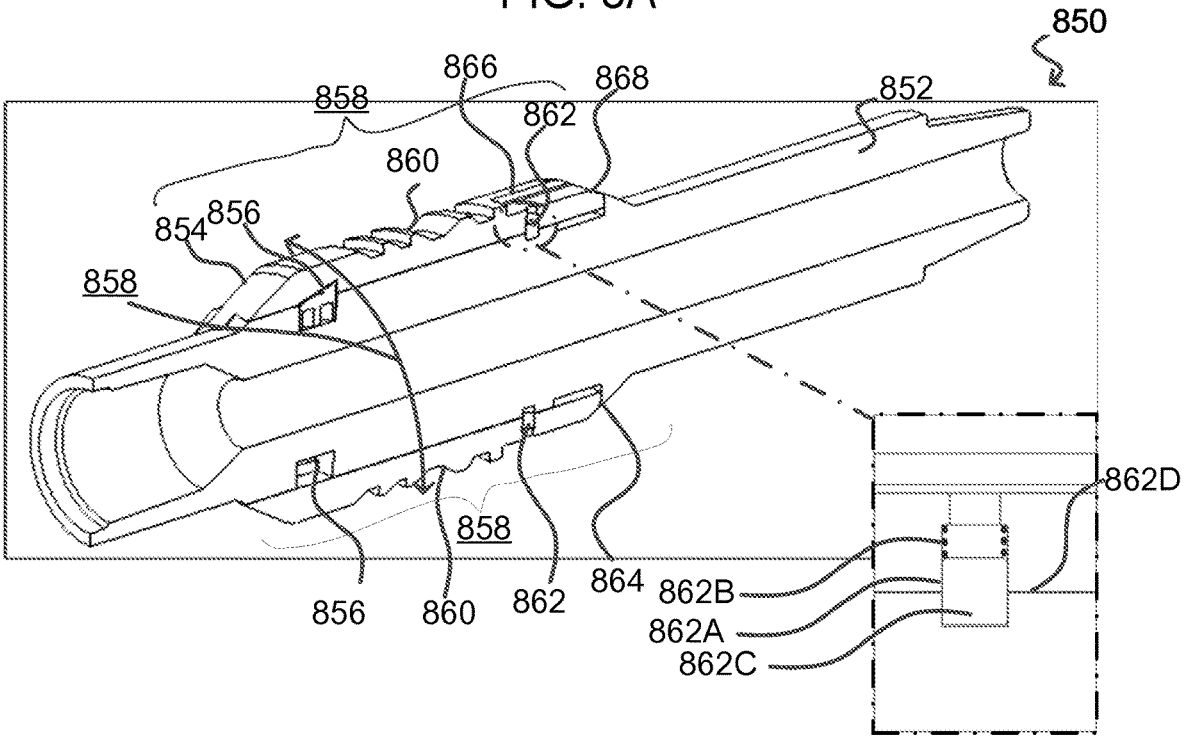
FIG. 8B illustrates further association details of a tool assembly with a tool body of FIG. 8A, for performing downhole run and/or retrieval operations, according to at least one embodiment.

FIG. 8B illustrates further association details 850 of a tool assembly 854, which is in a sleeve format, with a tool body 852, such a tool body 802 of FIG. 8A, for performing downhole run and/or retrieval operations, according to at least one embodiment. FIG. 8B illustrates, in a cross-sectional view, a section of an outer tool profile 858 of multiple blades 860 on a tool assembly 854. The outer tool profile 858 also includes an area 866 for a run aspect to be positioned. The run aspect may be WBs or NSPs to be landed by positioning such WBs or NSPs in the area 866 and releasing it into an appropriate part of the borewell or casing hanger. The tool assembly 854 is locked in place in its association with the tool body 802 via one or more releasable members 856 that is at a first lock and is shown to be within one or more angled indentations in the tool assembly 854.

FIG. 8B also illustrates that a bottom surface 864 of a tool assembly 854 to form a shoulder-surface interface of the system of the tool assembly 854 and tool body 852. As such, the tool assembly 854 is a cylindrical feature and not quarter or semi-circumferential sections as in FIGS. 6A-7B. Still further, FIG. 8B also illustrates that a distinct releasable member 862 that may be a J-slot or other release feature or interface can be used instead of a spring-loaded dog. The J-slot will require the cylindrical feature of the tool assembly 854 to be twisted relative to the tool body so that a pin 862C can fit within a slot 862A, followed by a spring closure 862B that holds the pin 862C and the tool assembly in a locked position. Further, the J-slot may be used with the spring-loaded dog, but with the spring-loaded dog providing an axial lock and the tool assembly required to be twisted into the J-slot so that the spring of the J-slot locks at the same time as the spring-loaded dog.

Figure 9A:
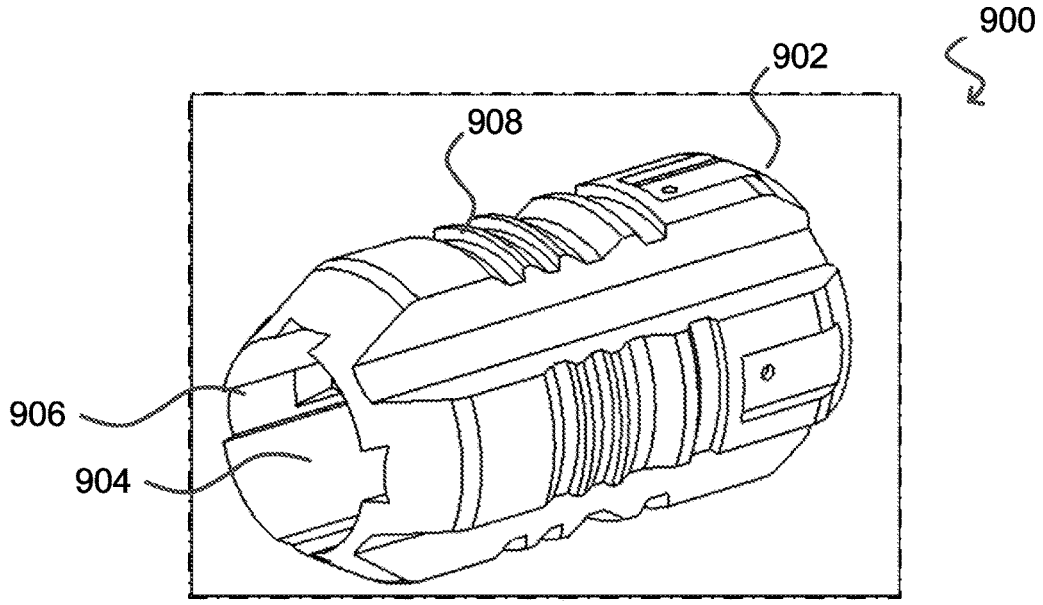
FIG. 9A illustrates alternate details of a sleeve format tool assembly, such as from FIG. 8B, for performing downhole run and/or retrieval operations, according to at least one embodiment.

FIG. 9A illustrates alternate details 900 of a sleeve format tool assembly 902, such as from FIG. 8B, for performing downhole run and/or retrieval operations, according to at least one embodiment. The tool assembly 902 is fitted over a tool body so that its inset dovetail features 906 forming an inner matching profile can be associated with an interfacing profile of the tool body. The tool assembly 902 can be changeably associated with the tool body to be used in the downhole run and/or retrieval operations of features. FIG. 9A also illustrates that the tool assembly 902 includes an outer tool profile 908. An angled indentation may be provided as discussed throughout herein to receive at least one releasable member of a tool body.

Figure 9B:
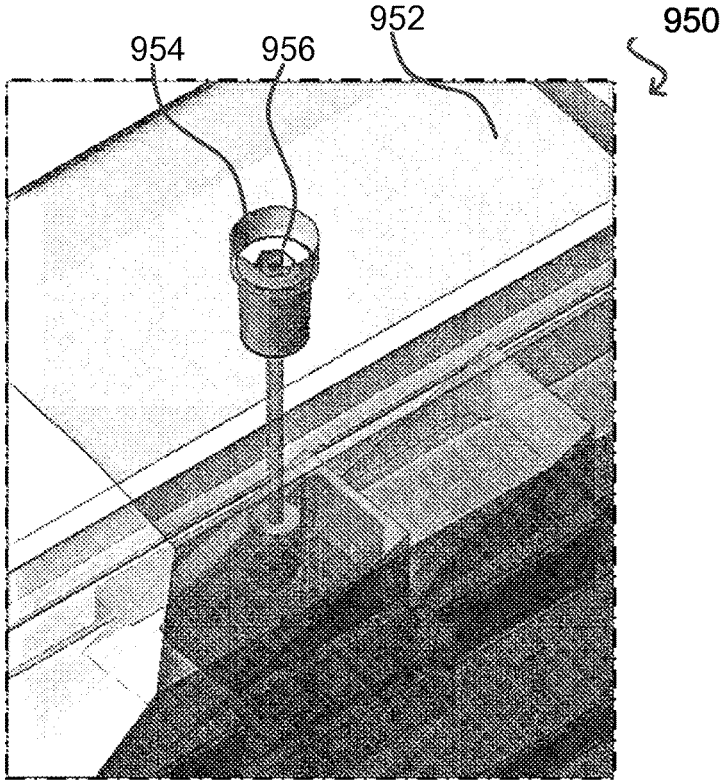
FIGS. 9B and 9C illustrate disassociation features for a tool assembly and tool body used for performing downhole run and/or retrieval operations, according to at least one embodiment.
Figure 9C:
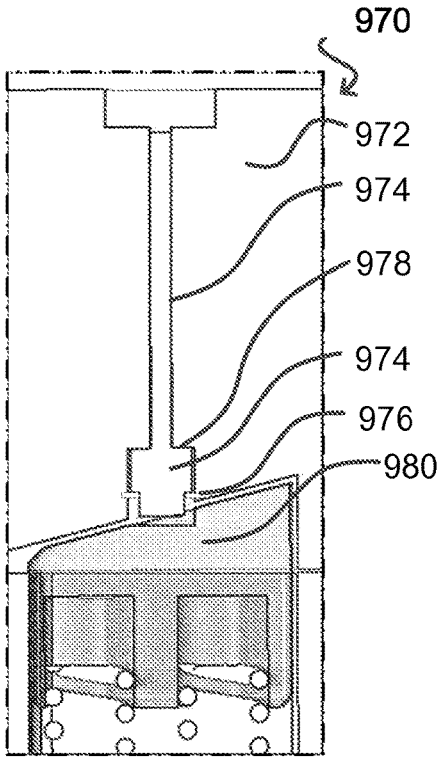

FIGS. 9B and 9C illustrate disassociation features 950, 970 for a tool assembly and tool body used for performing downhole run and/or retrieval operations, according to at least one embodiment. For example, a tool body 952; 972 includes a pluggable access port 954; 974. The pluggable access port 954, 974 can receive a plug 956 for closure of the access port 954; 974. In at least one embodiment, the plug 956 is a National Pipe Taper (NPT) plug to isolate the access port. In at least one embodiment, the access port can also receive or include a release tool, such as a release piston. Further, a retainer ring 976 may be provided to retain the release piston and to allow for downward motion to depress the releasable member 980, which can cause the releasable member to release and to enable disassociation of the tool assembly 972 from a tool body. The head of the plug 946 may support a wrench of screwdriver interface. A no-go shoulder 978 may be provided in the tool assembly 972 to stop the release piston from exiting its placement or to limit its movement.

Figure 10:
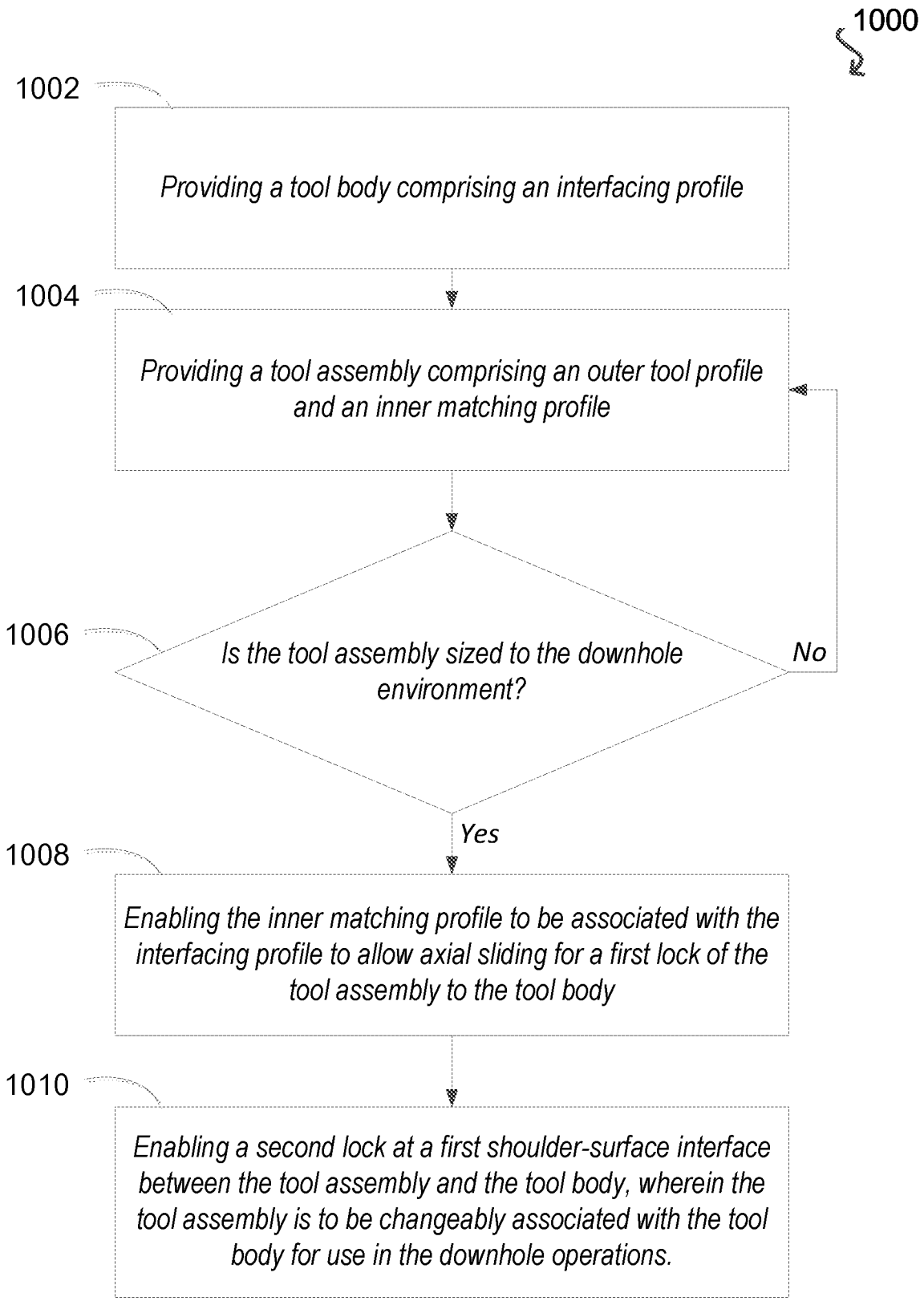
FIG. 10 is a flowchart illustrating a method associated with a tool assembly and tool body for performing downhole run and/or retrieval operations, according to at least one embodiment.

FIG. 10 is a flowchart illustrating a method 1000 associated with a tool assembly and tool body for performing downhole run and/or retrieval operations, according to at least one embodiment. In at least one embodiment, the method 1000 includes providing (1002) a tool body having an interfacing profile. The providing (1002) aspect may include provisioning of at least one releasable member within the tool body or tool assembly to be used in a downhole environment. The method also includes enabling (1004) a tool assembly to have an outer tool profile and an inner matching profile to be associated with the interfacing profile. Step 1004 may be performed by selection of a tool assembly or by repairing a tool assembly.

The enabling (1004) aspect may include provisioning of an indentation, such as an angled indentation, to receive at least one releasable member. For example, a spring-loaded dog can form part of at least one releasable member between tool body and the tool assembly so the at least one releasable member engaging or disengaging from the indentation can enable an association or a disassociation between the tool assembly and the tool body. In another example or together with the spring-loaded dog, a J-slot and a spring closure can be provided form part of at least one releasable member between tool body and the tool assembly. The at least one releasable member can enable an association or a disassociation between the tool assembly and the tool body.

A verification step (1006) may be provided to ensure that the tool assembly is sized or dimensioned to the application, such as the downhole environment. Step 1004 may be otherwise repeated. Step 1008 may be performed for enabling the inner matching profile to be associated with the interfacing profile to allow axial sliding for a first lock of the tool assembly to the tool body. Step 1010 may be performed for enabling a second lock at a first shoulder-surface interface between the tool assembly and the tool body. The tool assembly is enabled to be changeably associated with the tool body to use in the downhole environment for the downhole operations, including for run and/or retrieval operations of features. For example, the tool assembly may be push into a landed associated with the tool body and then pulled into a locked association with the tool body by steps 1008, 1010.

The method 1000 includes steps or sub-steps for enabling a number of raised or inset dovetail features to form part of the interfacing profile and for enabling a number of matching inset or raised dovetail features to form part of the inner matching profile. Such steps or sub-steps ensure that the tool assembly can be mated with the tool body. The method 1000 includes steps or sub-steps for enabling a passthrough feature and a shoulder-surface interface with the tool assembly aligned in a locked association with the tool body. This is so that the method 1000 can then perform part of an association or part of a disassociation between the tool assembly and the tool body using the passthrough feature and the shoulder-surface interface.

The method 1000 includes steps or sub-steps for enabling a spring-loaded dog to form part of the at least one releasable member. Further, the method 1000 includes steps or sub-steps for providing a railing feature to form part of the interfacing profile and for providing a seating feature to the railing feature. These steps or sub-steps enable the seating feature to form part of the inner matching profile so that the tool assembly slides over the tool body to be locked in place as part of the association with the tool body.

The method 1000 includes steps or sub-steps for enabling a pluggable access port of the tool assembly to receive a plug for closure or to receive or to include a release tool to cause the at least one releasable member to release and to enable disassociation of the tool assembly from the tool body. The method 1000 may apply to a tool assembly that is interchangeable among multiple tool assemblies, where each of the tool assemblies has different circumferential blades and blade types to access inner diameters of boreholes and casing hangers.

It should be appreciated that embodiments herein may utilize one or more values that may be experimentally determined or correlated to certain performance characteristics based on operating conditions under similar or different conditions. The present disclosure described herein, therefore, is well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art and are intended to be encompassed within the spirit of the present disclosure disclosed herein and the scope of the appended claims.

While techniques herein may be subject to modifications and alternative constructions, these variations are within spirit of present disclosure. As such, certain illustrated embodiments are shown in drawings and have been described above in detail, but these are not limiting disclosure to specific form or forms disclosed; and instead, cover all modifications, alternative constructions, and equivalents falling within spirit and scope of disclosure, as defined in appended claims.

Terms such as a, an, the, and similar referents, in context of describing disclosed embodiments (especially in context of following claims), are understood to cover both singular and plural, unless otherwise indicated herein or clearly contradicted by context, and not as a definition of a term. Including, having, including, and containing are understood to be open-ended terms (meaning a phrase such as, including, but not limited to) unless otherwise noted. Connected, when unmodified and referring to physical connections, may be understood as partly or wholly contained within, attached to, or joined together, even if there is something intervening.

Recitation of ranges of values herein are merely intended to serve as a shorthand method of referring individually to each separate value falling within range, unless otherwise indicated herein and each separate value is incorporated into specification as if it were individually recited herein. In at least one embodiment, use of a term, such as a set (for a set of items) or subset unless otherwise noted or contradicted by context, is understood to be nonempty collection including one or more members. Further, unless otherwise noted or contradicted by context, term subset of a corresponding set does not necessarily denote a proper subset of corresponding set, but subset and corresponding set may be equal.

Conjunctive language, such as phrases of form, at least one of A, B, and C, or at least one of A, B and C, unless specifically stated otherwise or otherwise clearly contradicted by context, is otherwise understood with context as used in general to present that an item, term, etc., may be either A or B or C, or any nonempty subset of set of A and B and C. In at least one embodiment of a set having three members, conjunctive phrases, such as at least one of A, B, and C and at least one of A, B and C refer to any of following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, terms such as plurality, indicates a state of being plural (such as, a plurality of items indicates multiple items). In at least one embodiment, a number of items in a plurality is at least two, but can be more when so indicated either explicitly or by context. Further, unless stated otherwise or otherwise clear from context, phrases such as based on means based at least in part on and not based solely on.

In at least one embodiment, even though the above discussion provides at least one embodiment having implementations of described techniques, other architectures may be used to implement described functionality, and are intended to be within scope of this disclosure. In addition, although specific responsibilities may be distributed to components and processes, they are defined above for purposes of discussion, and various functions and responsibilities might be distributed and divided in different ways, depending on circumstances.

In at least one embodiment, although subject matter has been described in language specific to structures and/or methods or processes, it is to be understood that subject matter claimed in appended claims is not limited to specific structures or methods described. Instead, specific structures or methods are disclosed as example forms of how a claim may be implemented.

From all the above, a person of ordinary skill would readily understand that the tool of the present disclosure provides numerous technical and commercial advantages, and can be used in a variety of applications. Various embodiments may be combined or modified based in part on the present disclosure, which is readily understood to support such combination and modifications to achieve the benefits described above.

The invention claimed is:

1. A system for downhole operations, comprising:

a tool body comprising an interfacing profile; and a tool assembly comprising an outer tool profile and an inner matching profile, the inner matching profile to be associated with the interfacing profile and to allow axial sliding of the tool assembly against the tool body for a first lock of the tool assembly to the tool body, wherein the axial sliding is along a longitudinal axis of a wellbore that is subject to the downhole operations, wherein a second lock is provided at a first shoulder-surface interface between the tool assembly and the tool body, and wherein the tool assembly is to be changeably associated with the tool body for use in the downhole operations.

2. The system of claim 1, further comprising:

a plurality of matching inset or raised dovetail features to form part of the inner matching profile and to enable the axial sliding of the inner matching profile of the tool assembly against the interfacing profile of the tool body.

3. The system of claim 1, further comprising:

a passthrough feature to form part of the second lock, the passthrough feature to allow a retention screw therethrough to hold the tool assembly against the tool body; and a second shoulder-surface interface at an opposite end from the passthrough feature to enable part of an association and part of a disassociation between the tool body and the tool assembly.

4. The system of claim 1, further comprising:

an indentation of the tool assembly to form part of the first lock; and at least one releasable member of the tool body to form part of the first lock, the at least one releasable member to act within the indentation of the tool assembly.

5. The system of claim 4, further comprising:

a pluggable access port of the tool assembly to receive a plug for closure or to receive or to include a release tool to cause the at least one releasable member to release and to enable the disassociation of the tool assembly from the tool body.

6. The system of claim 1, further comprising one or more of:

a removable retention feature to provide part of the second lock at the first shoulder-surface interface in the system.

7. The system of claim 1, further comprising:

a railing feature to form part of the interfacing profile; and a seating feature to form part of the inner matching profile and to enable the axial sliding of the tool assembly over the tool body.

8. The system of claim 1, wherein the tool assembly is interchangeable among a plurality of tool assemblies, individual ones of the plurality of tool assemblies comprising different circumferential blades and different blade types to access different inner diameters of boreholes and casing hangers.

9. A tool assembly comprising an outer tool profile, an inner matching profile, and a first interfacing surface, the inner matching profile to be associated with an interfacing profile of a tool body and to allow axial sliding of the tool assembly against the tool body for a first lock of the tool assembly to the tool body, wherein the axial sliding is along a longitudinal axis of a wellbore that is subject to the downhole operations, wherein a second lock is provided at a first shoulder-surface interface between the first interfacing surface and the tool body, and wherein the tool assembly is to be changeably associated with the tool body for use in the downhole operations.

10. The tool assembly of claim 9, further comprising:

a pluggable access port to receive a plug for closure or to receive or to include a release tool to cause at least the first lock to release.

11. The tool assembly of claim 9, wherein the tool assembly is interchangeable among a plurality of tool assemblies, individual ones of the plurality of tool assemblies comprising different circumferential blades and different blade types to access different inner diameters of boreholes and casing hangers.

12. The tool assembly of claim 9, further comprising:

a plurality of matching inset or raised dovetail features to form part of the inner matching profile, the plurality of matching inset or raised dovetail features to engage a plurality of raised or inset dovetail features that form part of the interfacing profile of the tool body.

13. The tool assembly of claim 9 further comprising:

a passthrough feature to form part of the second lock, the passthrough feature to allow a retention screw therethrough to hold the tool assembly against the tool body; or a second interfacing surface at an opposite end from the first interfacing surface, the second interfacing surface to enable a second shoulder-surface between the tool body and the tool assembly.

14. A method for downhole operations, comprising:

providing a tool body comprising an interfacing profile; and providing a tool assembly comprising an outer tool profile and an inner matching profile;

enabling the inner matching profile to be associated with the interfacing profile to allow axial sliding of the tool assembly against the tool body for a first lock of the tool assembly to the tool body, wherein the axial sliding is along a longitudinal axis of a wellbore that is subject to the downhole operations; and enabling a second lock at a first shoulder-surface interface between the tool assembly and the tool body, wherein the tool assembly is to be changeably associated with the tool body for use in the downhole operations.

15. The method of claim 14, further comprising:

enabling a plurality of matching inset or raised dovetail features to form part of the inner matching profile; and enabling the axial sliding of the inner matching profile of the tool assembly against the interfacing profile of the tool body.

16. The method of claim 14, further comprising:

enabling a passthrough feature to form part of the second lock, the passthrough feature to allow a retention screw therethrough to hold the tool assembly against the tool body; and enabling a second shoulder-surface interface at an opposite end from the passthrough feature for part of an association and a disassociation between the tool body and the tool assembly.

17. The method of claim 14, further comprising:

enabling an indentation of the tool assembly to form part of the first lock; and enabling at least one releasable member of the tool body to form part of the first lock, the at least one releasable member to act within the indentation of the tool assembly.

18. The method of claim 17, further comprising:

enabling a pluggable access port of the tool assembly to receive a plug for closure; or enabling pluggable access port of the tool assembly to receive or to include a release tool to cause the at least one releasable member to release and to enable the disassociation of the tool assembly from the tool body.

19. The method of claim 14, further comprising:

providing a removable retention feature for part of the second lock at the first shoulder-surface interface in the system.

20. The method of claim 14, wherein the tool assembly is interchangeable among a plurality of tool assemblies, individual ones of the plurality of tool assemblies comprising different circumferential blades and different blade types to access different inner diameters of boreholes and casing hangers.

* * * * *